US010174570B2

(12) United States Patent
Greening et al.

(10) Patent No.: US 10,174,570 B2
(45) Date of Patent: Jan. 8, 2019

(54) SYSTEM AND METHOD FOR MUD CIRCULATION

(71) Applicant: Nabors Drilling Technologies USA, Inc., Houston, TX (US)

(72) Inventors: Doug Christian Greening, Calgary (CA); Colin Trevor Maxwell, Elnora (CA); Ryan Thomas Bowley, Calgary (CA); Brent James-William Coombe, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 1101 days.

(21) Appl. No.: 14/532,801

(22) Filed: Nov. 4, 2014

(65) Prior Publication Data

US 2015/0122490 A1 May 7, 2015

Related U.S. Application Data

(60) Provisional application No. 61/901,253, filed on Nov. 7, 2013.

(51) Int. Cl.

| | |
|---|---|
| ***E21B 21/08*** | (2006.01) |
| ***E21B 19/06*** | (2006.01) |
| ***E21B 47/06*** | (2012.01) |
| ***E21B 21/10*** | (2006.01) |
| ***E21B 21/02*** | (2006.01) |
| ***E21B 19/16*** | (2006.01) |

(52) U.S. Cl.

CPC ..... *E21B 21/08* (2013.01); *E21B 19/06* (2013.01); *E21B 19/16* (2013.01); *E21B 21/02* (2013.01); *E21B 21/10* (2013.01); *E21B 21/106* (2013.01); *E21B 47/06* (2013.01)

(58) Field of Classification Search

CPC ..... E21B 21/08; E21B 21/02; E21B 21/10; E21B 21/106; E21B 19/06; E21B 19/16; E21B 47/06

See application file for complete search history.

(56) References Cited

U.S. PATENT DOCUMENTS

| | | | | |
|---|---|---|---|---|
| 4,422,513 A * | 12/1983 | Franklin | ..... | E21B 21/00 175/17 |
| 4,580,635 A * | 4/1986 | Radford | ..... | E21B 37/04 15/104.05 |
| 4,825,962 A * | 5/1989 | Girault | ..... | E21B 44/00 173/11 |
| 4,867,236 A | 9/1989 | Haney et al. | | |

(Continued)

OTHER PUBLICATIONS

AU Application No. 2014346904 Second Examination Report dated Mar. 23, 2017.

(Continued)

*Primary Examiner* — Matthew R Buck
*Assistant Examiner* — Aaron L Lembo
(74) *Attorney, Agent, or Firm* — Enrique Abarca; Abel Law Group, LLP

(57) ABSTRACT

Present embodiments are directed to a control system including a controller configured to regulate a drilling fluid flow through a pipe element during installation of the pipe element into a wellbore or removal of the pipe element from the wellbore, wherein the controller is configured to regulate the drilling fluid flow based on feedback from one or more sensors of the control system.

18 Claims, 17 Drawing Sheets

(56) References Cited

U.S. PATENT DOCUMENTS

| | | | | |
|---|---|---|---|---|
| 5,036,927 | A | 8/1991 | Willis | |
| 6,032,929 | A * | 3/2000 | Vatne | E21B 15/00 166/122 |
| 6,484,816 | B1 * | 11/2002 | Koederitz | E21B 21/08 175/25 |
| 6,820,702 | B2 * | 11/2004 | Niedermayr | E21B 21/08 175/24 |
| 6,904,981 | B2 * | 6/2005 | van Riet | E21B 21/08 166/265 |
| 7,677,331 | B2 * | 3/2010 | Lowe | E21B 19/22 166/77.2 |
| 7,908,034 | B2 * | 3/2011 | Gray | E21B 21/00 175/24 |
| 9,359,835 | B2 * | 6/2016 | Leman | E21B 19/00 |
| 9,605,500 | B2 * | 3/2017 | Yajure | E21B 21/08 |
| 9,650,880 | B2 * | 5/2017 | Bowley | E21B 44/04 |
| 9,725,971 | B2 * | 8/2017 | Yajure | E21B 19/165 |
| 2004/0040746 | A1 * | 3/2004 | Niedermayr | E21B 21/08 175/38 |
| 2009/0139767 | A1 * | 6/2009 | Jeffryes | E21B 21/08 175/40 |
| 2009/0194330 | A1 * | 8/2009 | Gray | E21B 21/00 175/24 |
| 2009/0272580 | A1 * | 11/2009 | Dolman | E21B 21/003 175/48 |
| 2011/0100710 | A1 * | 5/2011 | Fossli | E21B 21/001 175/7 |
| 2011/0155379 | A1 | 6/2011 | Bailey et al. | |
| 2013/0153244 | A1 | 6/2013 | Nikiforuk | |
| 2013/0168105 | A1 | 7/2013 | Leman et al. | |
| 2013/0168106 | A1 | 7/2013 | Leman et al. | |
| 2014/0060931 | A1 * | 3/2014 | Pettapiece | E21B 44/00 175/27 |
| 2014/0224509 | A1 * | 8/2014 | Yajure | E21B 19/165 166/380 |
| 2014/0305702 | A1 * | 10/2014 | Bowley | E21B 44/04 175/27 |
| 2015/0053483 | A1 | 2/2015 | Mebane, III | |
| 2015/0300109 | A1 * | 10/2015 | Yajure | E21B 21/08 166/373 |
| 2015/0337606 | A1 * | 11/2015 | Bowley | E21B 41/0085 175/38 |

OTHER PUBLICATIONS

PCT/US2014/064087 Invitation to Pay Additional Fees dated Oct. 29, 2015.

* cited by examiner

FIG. 3
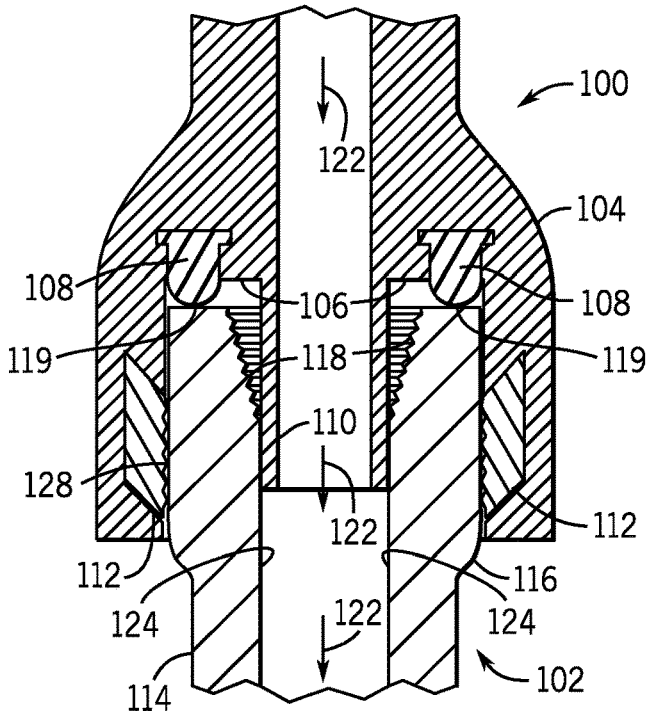
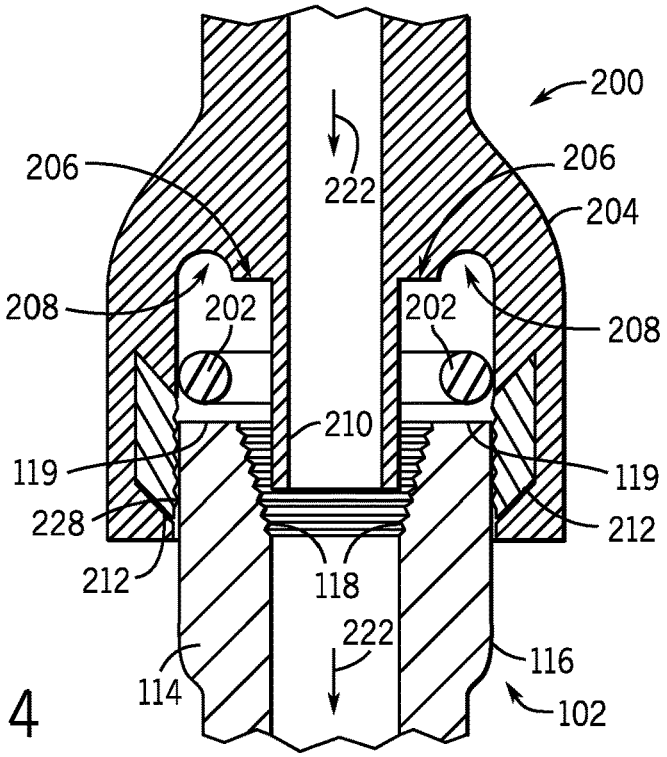
FIG. 4

SYSTEM AND METHOD FOR MUD CIRCULATION

BACKGROUND

Present embodiments relate generally to the field of drilling and processing of wells, and, more particularly, to a system and method for circulating mud or other fluid during insertion and removal of drillpipe elements into and out of a wellbore during drilling operations and the like.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore. Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore. An initial drillpipe element may be positioned in the wellbore and held in place by gripping devices near the rig floor, such as slips. Subsequent drillpipe elements may then be coupled to the existing drillpipe elements in the wellbore to continue formation of the drill string. Once attached, the drillpipe element and remaining drill string may be held in place by an elevator and released from the gripping devices (e.g., slips) such that the drill string can be lowered into the wellbore. Once the drill string is in place, the gripping devices can be reengaged to hold the drill string such that the elevator can be released and the process of attaching drillpipe elements can be started again. Similar procedures may be utilized for removing drillpipe from the wellbore. These procedures are generally referred to as tripping in and tripping out, respectively.

It is now recognized that certain aspects of these existing techniques are inefficient because of various limitations (e.g., environmental limitations) during certain phases of operation. For example, the speed at which drillpipe is inserted and removed into and from the wellbore may be limited due to pressure and/or vacuum forces created within the wellbore during insertion and removal of the drillpipe. These variations in pressure can cause the well to frack when the pressure is increased and cause the well to kick under lower pressure scenarios.

DRAWINGS

These and other features, aspects, and advantages of the present invention will become better understood when the following detailed description is read with reference to the accompanying drawings in which like characters represent like parts throughout the drawings, wherein:

FIG. 3 is a schematic cross-sectional view of a gripping device with an integral seal and a drillpipe element in accordance with present techniques;

FIG. 4 is a schematic cross-sectional view of a gripping device, a separate seal, and a drillpipe element in accordance with present techniques;

DETAILED DESCRIPTION

Present embodiments are directed to systems and methods for circulating mud or other fluid within a wellbore during insertion and/or removal of drillpipe elements into and out of a wellbore during drilling operations and the like. A pipe drive system may be used to facilitate assembly and disassembly of drill strings. Indeed, a pipe drive system may be employed to engage and lift a drillpipe element (e.g., a drillpipe joint), align the drillpipe element with a drill string, stab a pin end of the drillpipe element into a box end of the drill string, engage the drill string, and apply torque to make-up a coupling between the drillpipe element and the drill string. Thus, a pipe drive system may be employed to extend the drill string. Similarly, the pipe drive system may be used to disassemble drillpipe elements from a drill string by applying reverse torque and lifting the drillpipe elements out of the engagement with the remaining drill string. It should be noted that torque may be applied using a top drive system coupled to the pipe drive system or integral with the pipe drive system.

During a process of installing or removing drillpipe elements, it may be desirable to circulate fluids (e.g., drilling mud) through the associated drill string. Accordingly, the pipe drive system may be configured to create a seal between the drillpipe handling equipment and the drillpipe element such that fluid can efficiently pass from the pipe drive system into the drillpipe element. In accordance with present embodiments, a flow of mud or other fluid through the drillpipe elements and within the wellbore may be controlled and regulated, as desired, during insertion or removal of the drillpipe elements. For example, the flow of mud or other fluid may be controlled based on measured feedback or operating parameters associated with the insertion and/or removal of the drillpipe elements. The measured feedback may include a speed of the insertion or removal of the drillpipe elements into or from the wellbore, a flow rate of the mud or other fluid circulated within the wellbore, a measured pressure or vacuum within the wellbore, and so forth.

Figure 1:
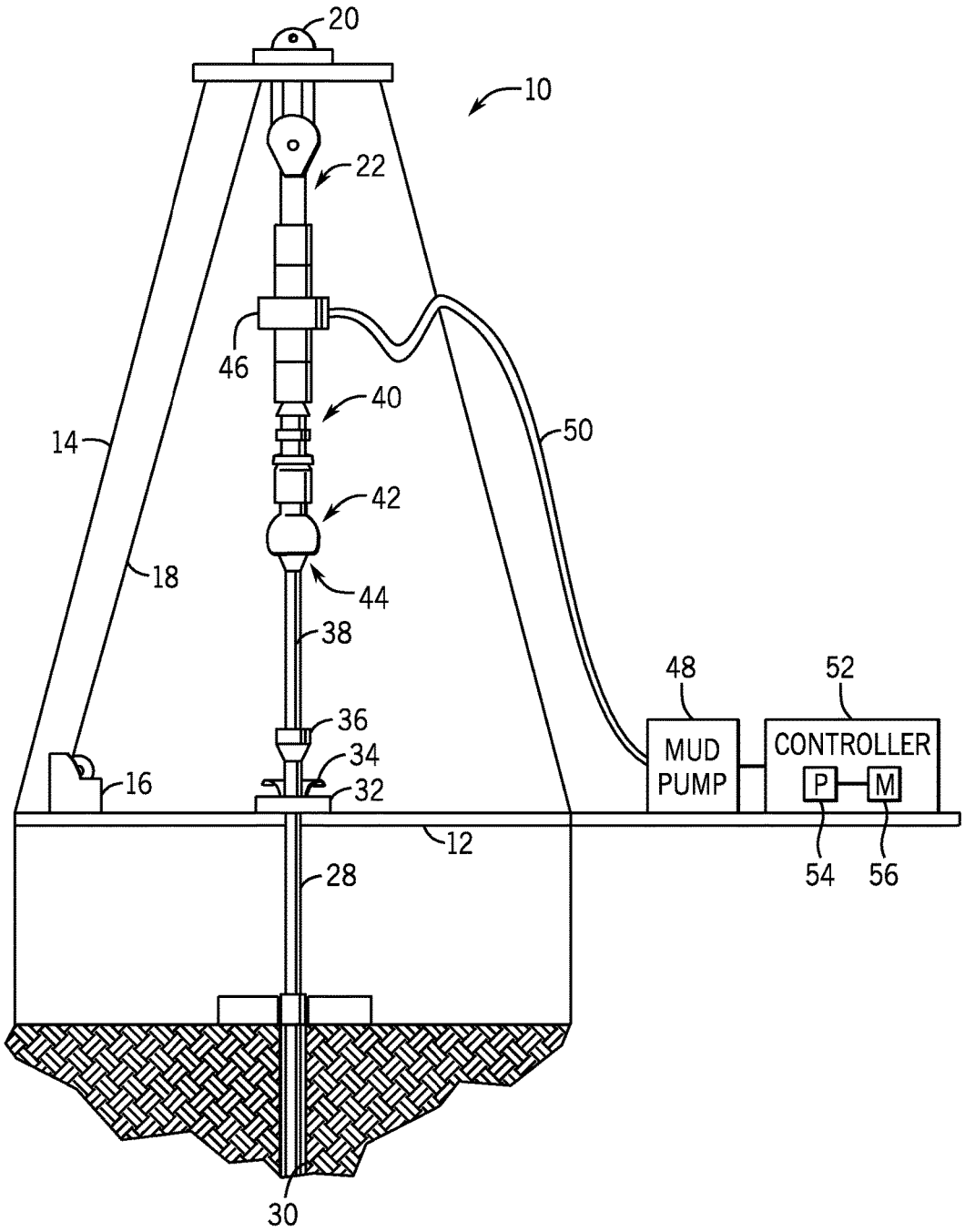
FIG. 1 is a schematic of a well being drilled in accordance with present techniques.

Turning now to the drawings, FIG. 1 is a schematic of a drilling rig 10 in the process of drilling a well in accordance with present techniques. While FIG. 1 represents the drilling rig 10 during a drilling process, present embodiments may be utilized for disassembly processes and so forth. In particular, present embodiments may be employed in procedures including assembly or disassembly of drillpipe elements, wherein it is desirable to provide and control an amount of fluid circulation through the drillpipe elements from a drillpipe handling system during assembly or disassembly procedures. Furthermore, present embodiments may be used to provide and control fluid circulation for removing cuttings during drilling of the earth formation and for controlling the well.

In the illustrated embodiment, the drilling rig 10 features an elevated rig floor 12 and a derrick 14 extending above the rig floor 12. A supply reel 16 supplies drilling line 18 to a crown block 20 and traveling block 22 configured to hoist various types of equipment and drillpipe above the rig floor 12. The drilling line 18 may be secured to a deadline tiedown anchor. Further, a draw works may regulate the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drillpipe element or length of drillpipe 38 is in the process of being added.

The length of drillpipe 38 is held in place by a pipe drive system 40 that is hanging from the traveling block 22. Specifically, a gripping device 42 of the pipe drive system 40 is engaged about an outer perimeter of a distal end 44 of the drillpipe 38. This attachment via the gripping device 42 enables the pipe drive system 40 to maneuver the drillpipe 38. In the illustrated embodiment, the pipe drive system 40 is holding the drillpipe 38 in alignment with the stump 36. The gripping device 42 may include an integral seal or may be configured to couple with the drillpipe 38 about a seal such that a sealed passage is established between the pipe drive system 40 and the drillpipe 38. Establishing this sealed passage facilitates circulation of fluid (e.g., drilling mud) through the pipe drive system 40 into the drillpipe 38 and the drill string 28. Further, the gripping device 42 couples with the drillpipe 38 in a manner that enables translation of motion to the drillpipe 38. Indeed, in the illustrated embodiment, the pipe drive system 40 includes a top drive 46 configured to supply torque for making-up and unmaking a coupling between the drillpipe 38 and the stump 36. It should be noted that, in some embodiments, the top drive 46 is separate from the pipe drive system 40.

To facilitate the circulation of mud or other drilling fluid within the wellbore 30, the drilling rig 10 includes a mud pump 48 configured to pump mud or drilling fluid up to the pipe drive system 40 through a mud hose 50. From the pipe drive system 40, the drilling mud will flow through internal passages of the gripping device 42, into internal passages of the drillpipe 38 and the drill string 28, and into the wellbore 30 to the bottom of the well. The drilling mud flows within the wellbore 30 (e.g., in an annulus between the drill string 28 and the wellbore 30) and back to the surface where the drilling mud may be recycled (e.g., filtered, cleaned, and pumped back up to the pipe drive system 40 by the mud pump 48).

The illustrated embodiment of the drilling rig 10 further includes a controller 52 having one or more microprocessors 54 and a memory 56. The memory 56 is a non-transitory (not merely a signal), computer-readable media, which may include executable instructions that may be executed by the microprocessor 54. The controller 52 is configured to regulate operation of the mud pump 48 and/or other features of the drilling rig 10. For example, the controller 52 may be configured to regulate a flow rate of mud or other drilling fluid circulated through the drill string 28 and the wellbore 30 during installation or removal of drillpipe elements. In this manner, the process of installing and/or removing drillpipe elements may be improved. For example, the speed at which drillpipe elements are installed and/or removed may be increased. In certain embodiments, the controller 52 may regulate operation of the mud pump 48 to increase and/or decrease mud flow into the drill string 28 and wellbore 30 to reduce vacuum forces (e.g., "swabbing" effects) generated within the wellbore 30 during removal of drillpipe elements or reduce pressure forces generated within the wellbore 30 during installation of drillpipe elements. The controller 52 may also regulate other components of the drilling rig 10 to control flow of drilling mud. For example, the controller 52 may control operation of a valve in the pipe drive system 40 and/or a valve disposed along the mud hose 50, as described in further detail below. The regulation of mud flow into the drill pipe 28 and wellbore 30 may increase speed and efficiency of removal of drillpipe elements by reducing friction of the drill string 28 during removal or increasing buoyancy of the drill string 28 within the wellbore 30.

As discussed in detail below, the controller 52 may further regulate operation of the mud pump 48 or other flow control components of the drilling rig 10, and thus the flow rate of drilling mud into the drill string 28 and wellbore 30, based on feedback (e.g. measured feedback) from the drilling rig 10. For example, the drilling rig 10 may include sensors configured to measure various operating parameters, such as drilling line 18 supply or retrieval speed, wellbore 30 pressure, drilling mud flow rate, mud pump 48 shaft speed, or other operating parameter. Based on such feedback, the operation of the mud pump 48 may be adjusted by the controller 52. For example, the mud pump 48 may supply drilling mud to the pipe drive system 40 more quickly or more slowly based on the feedback. In other embodiments, the controller 52 may be configured to regulate the flow of drilling mud into the drill string 28 and the wellbore 30 based on a calculated profile or schedule. For example, based on the drill string 28 assembly or disassembly process, various drilling mud flow rates and corresponding times may be calculated to create a profile or schedule, and the controller 52 may regulate the flow of drilling mud based on the profile or schedule. For example, the controller 52 may regulate the flow of drilling mud such that the drilling mud flows at a first flow rate for a first time period when drillpipe 38 is being removed from the well, and then the controller 52 may increase the flow rate of drilling mud for a second time period (e.g., subsequent time period) after the drillpipe 8 is removed but before the drillpipe 38 is disconnected (e.g., unthreaded) from the drill string 28 (e.g., to assist in clearing the column of drilling mud remaining in the removed drillpipe 38).

Figure 2:
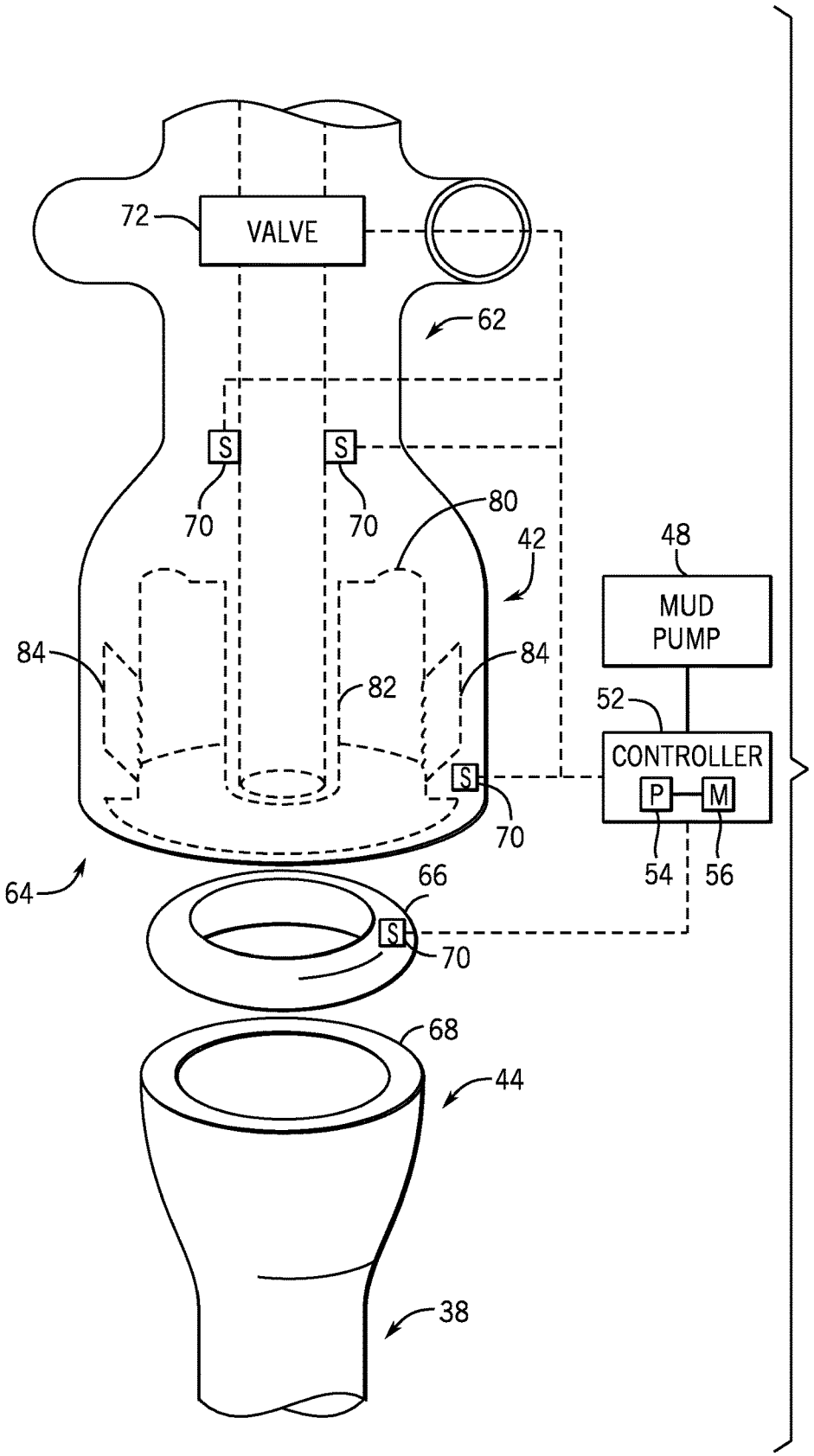
FIG. 2 is an exploded perspective view of a coupling between a gripping device and a drillpipe element in accordance with present techniques.

FIGS. 2-4 illustrate various views of an embodiment of a coupling between the gripping device 42 and the drillpipe 38. As discussed in detail below, the coupling between the gripping device 42 and the drillpipe 38 creates a seal between the gripping device 42 and the drillpipe 38 and thereby enables drilling mud to be supplied by the mud pump 48 into the drillpipe 38, drill string 28, and wellbore 30 quickly and efficiently. For example, the drilling mud may be pumped or circulated within the wellbore 30 during installation or removal of drillpipe components into or from the wellbore 30. However, it should be appreciated that the embodiment of the coupling shown in FIGS. 2-4 is one potential embodiment of a coupling between the gripping device 42 and the drillpipe 38. In other embodiments, other types of couplings may be used between the gripping device 42 and the drillpipe 38. In still other embodiments, the gripping device 42 may not be used, and the drillpipe 38 may be coupled to other components (e.g., threaded to another section of drillpipe 38). In such embodiments, the mud pump 48 may supply a drilling mud flow to the pipe drive system 40, the drillpipe 38, the drill string 28, and the wellbore 30 during installation and/or removal of drillpipe components. Additionally, in such embodiments, the operation of the mud pump 48 or other components (e.g., valves) may be regulated by the controller 52 based on feedback (e.g., measured feedback) from other components of the drilling rig 10.

FIG. 2 is an exploded perspective view of a coupling between the gripping device 42 and the drillpipe 38. Further, FIG. 2 illustrates a cross-sectional representation of certain internal components of the gripping device 42. Specifically, in accordance with the illustrated embodiment, the gripping device 42 includes a base end 62 and a drillpipe engagement end 64. The base end 62 may be integral with the pipe drive system 40 or it may include coupling features for attachment to the pipe drive system 40. The drillpipe engagement end 64 is configured to engage the distal end 44 of the drillpipe 38 such that a seal 66 is pressed between the gripping device 42 and a face 68 of the drillpipe 38 to create a sealed passage. The sealed passage may enable drilling mud to be pumped into the drillpipe 38, drill string 28, and wellbore 30 quickly and efficiently. In certain embodiments, this pumping may be controlled by the controller 52 based on measurements from sensors 70 disposed within the gripping device 42. In one embodiment, one or more of the sensors 70 may be configured to monitor a pressure acting on or applied by the seal 66. That is, when the seal 66 is pressed between the gripping device 42 and the face 68 of the drillpipe 38, the one or more of the sensors 70 may be configured to measure a pressure or force acting on the seal 66. For example, the one of the sensors 70 may be a strain gauge positioned on the seal 66. Upon detecting a measured pressure of the seal 66 that meets or exceeds a threshold pressure value (e.g., which may be stored in the memory 56 of the controller 52), the controller 52 may initiate a flow of drilling mud through the gripping device 42 and the drillpipe 38. More specifically, the controller 52 may be configured to initiate operation of the mud pump 48 to supply drilling mud to the gripping device 42 and/or the controller 52 may operate a valve 72 disposed within the gripping device 42 to allow drilling mud to flow through the gripping device 42 and into the drillpipe 38.

In the illustrated embodiment, the seal 66 is separate from the gripping device 42 and is held in position by the engagement of the gripping device 42 with the drillpipe 38. For example, the seal 66 may be designed to be disposable such that new seals 66 may be utilized each time a different drillpipe 38 is coupled with the gripping device 42 or after a certain number of uses. Indeed, after one or more uses, the structure of the seal 66 and the material forming the seal 66 may become degraded such that the seal 66 ceases to function properly. In this case, an operator can simply obtain another disposable seal 66 and position it on the face 68 of the drillpipe 38 before lowering the gripping device 42 over the drillpipe 38. Facilitating frequent replacement of the seal 66 by employing disposable seals 66 substantially limits the functional requirements of the seal 66 in accordance with present techniques. In other embodiments, the seal 66 may be coupled directly to the gripping device 42 via adhesive, installment in a receptacle (e.g., a groove), or the like. Indeed, in some embodiments, the seal 66 may be imbedded or integral with the gripping device 42. For example, the seal 66 may be integrated with the gripping device 42 such that the gripping device 42 must be replaced when the seal 66 is no longer functional. In embodiments where the seal 66 is integrated with or embedded within the gripping device 42, the seal 66 may be designed to withstand long-term use. As an example, whether separate from or integral with the gripping device 42, the seal 66 may be formed from nitrile rubber and may be designed to withstand pressures ranging from 1,000 psi to 6,000 psi on the surface area of the seal 66. As mentioned above, the pressure acting on the seal 66 may be measured by one of the sensors 70, and the controller 52 may be configured to regulate a flow of drilling mud through the gripping device 42 and the drillpipe 38 based on the measured pressure of the seal 66.

Internal features of the gripping device 42 include a device face 80, a filler neck 82 extending from the device face 80, and engagement features 84. The device face 80 of the gripping device 42 is configured to abut the seal 66 such that the seal 66 is pressed between the device face 80 and the drillpipe face 68 of the distal end 44 of the drillpipe 38 when the gripping device 42 is properly coupled with the drillpipe 38. Such a coupling may be achieved by aligning the device face 80, the seal 66, and the drillpipe face 68 and then setting the gripping device 42 down on top of the drillpipe seal 66 and drillpipe 38. The weight of the pipe drive system 40, which may include the weight of the top drive 46, may assist in creating a 1,000 to 6,000 pound seal. In some situations, even higher seal pressure may be achieved. Indeed, the top drive 46 alone may weigh as much as 15 tons or more. As will be discussed below, once established, this seal may be maintained by coupling the gripping device 42 to the drillpipe 38 via the engagement features 84. Further, the activated seal may block flow of fluids outside of the drillpipe 38 and across other features of the gripping device 42, such as the engagement features 84, which may be degraded by fluids used for circulation.

After or during establishment of such a compressive seal, the engagement features 84 (e.g., frictional engagement slips) may be actuated to maintain the coupling between the gripping device 42 and the drillpipe 38. For example, the engagement features 84 may be hydraulically, mechanically, electronically or otherwise actuated to radially engage a circumferential area of the drillpipe 38 by a control feature, or the engagement features 84 may be automatically actuated in a radial direction based on the downward force applied by setting the gripping device 42 down on the seal 66 and the drillpipe face 68. Indeed, various mechanisms may be utilized to facilitate a frictional coupling between the outer circumferential area of the drillpipe 38 and the engagement features 84. The engagement features 84 generally include a textured surface that facilitates frictional engagement with the drillpipe 38 such that the gripping device 42 can be utilized to lift the drillpipe 38 and such that rotational movement is readily translated from the gripping device 42 to the drillpipe 38. Those having ordinary skill in the art will appreciate that the sealing features in accordance with present embodiments are independent of the manner in which the gripping of the drill pipe 38 is actuated and achieved.

Further, the process of coupling the gripping device 42 with the drillpipe 38 includes slidably positioning the filler neck 82 within the drillpipe 38. The filler neck 82 is sufficiently sized to fit within the inside diameter of one or more different types of drillpipe 38. Due to the shape and positioning of the filler neck 82 with respect to the gripping device 42, this engagement occurs as a result of positioning the gripping device 42 over the drillpipe 38. Indeed, the filler neck 82 may essentially guide such an engagement by extending into the drillpipe 38. Although shown as cylindrical, the filler neck 82 may be conical or otherwise shaped to avoid hanging up on threads of the drillpipe 38. Thus, a flow path extending through the pipe drive system 40 is extended into the drillpipe 38 via the filler neck 82, which facilitates fluid circulation from the pipe drive system 40 into the drillpipe 38 and any coupled drill string 28. In some embodiments, the filler neck 82 may be excluded. However, it may be beneficial to include the filler neck 82 for reducing back flow and resisting the washing of fluid across the connection. That is, the filler neck 82 may function to reduce wear or washout of the seal 66 and other features of the system. For example, it may be desirable for the filler neck 82 to be of sufficient length to extend past the threads of the distal end 44 of the drillpipe 38 to reduce wear on the threads, reduce wear on the seal 66, and generally encourage flow into the drillpipe 38 and any associated drill string 28. In other embodiments, the filler neck 82 may include threads configured to engage with corresponding threads on an inner diameter of the drillpipe 38. In certain embodiments, the engagement features 84 of the gripping device 42 may include threads configured to engage with corresponding threads formed on an outer diameter of the drillpipe 38.

FIG. 3 is a schematic cross-sectional view of a gripping device 100 in the process of being coupled with a drillpipe element 102. As similarly discussed above, the gripping device 100 creates a seal with the drillpipe element 102 to enable quick and efficient transfer of drilling mud from the pipe drive system 40 to the drillpipe element 102, the drill string 28, and the wellbore 30. For example, drilling mud may be pumped and circulated during installation or removal of the drillpipe elements. As a result, installation and/or removal of the drillpipe elements may be improved (e.g., quickened). In the illustrated embodiment, the gripping device 100 includes a housing 104, a coupling device or housing face 106, an integral seal 108, a filler neck 110, and engagement pads 112 (also known in the art as "slips"). As discussed above, the gripping device 100 may also include sensors (e.g., sensors 70 shown in FIG. 2) configured to monitor various operating parameters of the gripping device 100, such as a pressure of the integral seal 108. The drillpipe element 102 includes a drillpipe body 114, a tool joint 116, threads 118, and a drillpipe face 119.

Specifically, the arrangement of the gripping device 100 and the drillpipe element 102 illustrated by FIG. 3 represents the gripping device 100 being set down on the drillpipe element 102 such that, as generally discussed above, pressure or force (e.g., the weight of a top drive or pipe drive system) is applied to the integral seal 108 via the gripping device 100 and the drillpipe element 102. This force or pressure, which may be monitored via sensors (e.g., sensors 70 shown in FIG. 2), causes deformation of the integral seal 108 and establishment of a pressurized seal in a seal area between a flow path 122 through the gripping device 100 and drillpipe element 102, and areas outside of the flow path 122. Once a suitable pressure of the integral seal 108 is measured via one or more sensors, the mud pump 48 may be controlled by the controller 52 to supply a flow of drilling mud through the gripping device 100 and the drillpipe element 102. In another embodiment, the controller 52 may be configured to regulate operation of a valve (e.g., valve 72 shown in FIG. 2) of the gripping device 100 to enable drilling mud flow through the gripping device 100 and the drillpipe element 102. In other embodiments, a valve controlled by the controller 52 to enable drilling mud flow may be disposed along the mud hose 50, within the pipe drive system 40, or within the top drive 46.

The flow path 122 includes the filler neck 110, which extends into the drillpipe element 102. While embodiments in accordance with the present techniques may not include such a feature, the illustrated embodiment includes the filler neck 110 to direct fluid flow past the threads 118 of the drillpipe element 102 and past the integral seal 108. Indeed, when fully inserted, the filler neck 110 is of sufficient length to extend past the integral seal 108 and past the threads 118 to limit interaction of circulation fluid with these components. Further, the filler neck 110 is sized such that it has limited clearance between the walls of the 124 drillpipe element 102, which creates resistance to back flow of the fluid towards the threads 118 and integral seal 108. The inclusion and sizing of the filler neck 110 will thus resist degradation of features of the gripping device 100 and drillpipe element 102 due to washout and so forth.

In the illustrated embodiment, the engagement pads 112 have not yet engaged with the outer circumferential area of the drillpipe element 102. However, once the pressurized seal is established to a desired degree, the engagement pads 112 may be actuated to radially engage an exterior of the drillpipe element 102. For example, as similarly described above, the gripping device 100 may include sensors (e.g., sensors 70 shown in FIG. 2) configured to monitor a pressure of the integral seal 108. Once the measured pressure of the integral seal 108 meets or exceeds a threshold level, the controller 52 may actuate the engagement pads 112 of the gripping device 100. In some embodiments, the engagement pads 112 may be radially actuated by pushing them up or down with respect to an axis of the gripping device 100 such that they slide along a ramp that presses the engagement pads 112 radially inward to engage the drillpipe element 102. This actuation may be achieved in various manners, such as hydraulically or based on frictional engagement with the drillpipe element 102. For example, sliding the drillpipe element 102 between the engagement pads 112 may cause the engagement pads 112 to slide upwards against a ramp that pushes the engagement pads 112 radially inward. In another embodiment, the engagement pads 112 may be pressed radially inward without any vertical sliding motion. Indeed, various different actuation techniques and engagement features may be utilized in accordance with present embodiments.

In the illustrated embodiment, patterns 128 on the surface of the engagement pads 112 are configured to function as wickers and may be pressed into contact with the outer circumferential area of the tool joint 116 to establish a frictional coupling between the gripping device 100 and the drillpipe element 102. The patterns 128 may be arranged to provide resistance to movement in multiple directions once engaged. For example, the patterns 128 may include upwardly angled teeth and teeth aligned with an axis of the drillpipe element 102 such that rotational and lifting motions are efficiently imparted to the drillpipe from the gripping device 100. In this way, force from a top drive coupled to the gripping device 100 can be utilized to lift or rotate the drillpipe 102 during an assembly or disassembly process.

FIG. 4 is a schematic cross-sectional view of a gripping device 200 in the process of being coupled with the drillpipe element 102 about a separate seal 202. As similarly discussed above, the gripping device 200 creates a seal with the drillpipe element 102 to enable quick and efficient transfer of drilling mud from the pipe drive system 40 to the drillpipe element 102, the drill string 28, and the wellbore 30. For example, drilling mud may be pumped and circulated during installation or removal of the drillpipe elements. As a result, installation and/or removal of the drillpipe elements may be improved (e.g., quickened). In the illustrated embodiment, the gripping device 200 includes a housing 204, a coupling device or housing face 206, a seal groove 208, a filler neck 210, and engagement pads 212. As discussed above, the gripping device 200 may also includes sensors (e.g., sensors 70 shown in FIG. 2) configured to monitor various operating parameters of the gripping device 200, such as a pressure of the separate seal 202. The drillpipe element 102 includes the drillpipe body 114, the tool joint 116, the threads 118, and the drillpipe face 119.

Specifically, the arrangement of the gripping device 200 and the drillpipe element 102 illustrated by FIG. 4 represents the gripping device 200 being set down on the drillpipe element 102 after the separate seal 202 has been positioned on the drillpipe face 119. As generally discussed above, once the separate seal 202 is abutting the housing face 206 and the drillpipe face 119 within a seal area, pressure or force (e.g., the weight of a top drive or pipe drive system) may be applied to cause deformation of the separate seal 202. Thus, the separate seal 202 is utilized to establish a pressurized seal between a flow path 222 through the gripping device 200 and drillpipe element 102, and areas outside of the flow path 222. As similarly described above, the pressure of the pressurized seal may be monitored by one or more sensors (e.g., sensors 70 of FIG. 2). For example, a strain gauge may be positioned on the separate seal 202 and may be configured to measure a pressure of the separate seal 202. In certain embodiments, when the measured pressure of the separate seal 202 meets or exceeds a threshold pressure (i.e., when the gripping device 200 and the drillpipe element 102 are engaged with one another), the controller 52 may be configured to regulate operation of one or more components of the drilling rig 10 to actuate a drilling mud flow through the gripping device 200 and the drillpipe element 102. For example, the controller 52 may be configured to operate the mud pump 48, a valve (e.g., valve 72 shown in FIG. 2), or other component to enable drilling mud flow through the gripping device 200 and the drillpipe element 102 once the measured pressure of the separate seal 202 meets or exceeds a threshold pressure.

In the illustrated embodiment, the housing face 206 includes the seal groove 208, which is formed to provide a receptacle for the separate seal 202. In the illustrated embodiment, the separate seal 202 has been positioned on the drillpipe face 119 such that when it engages with the housing face 206, the separate seal 202 will be pressed into the seal groove 208. In other situations, the separate seal 202 may be initially installed within the seal groove 208 before coupling the gripping device 202 with the drillpipe element 102. Including a receptacle such as the seal groove 208 may stabilize the separate seal 202 and provide additional seal integrity. However, in some embodiments, the housing face 206 may not include the seal groove 208 or any type of receptacle for the separate seal 208. Rather, in some embodiments, the housing face 206 may be substantially flat and/or textured for engagement with the separate seal 202 such that it can be pressed between the housing face 206 and the drillpipe face 119.

Other aspects of the gripping device 200 illustrated in FIG. 4 are similar to those of the gripping device 100 illustrated in FIG. 3. For example, when the flow path 222 is established by coupling the gripping device 200 with the drillpipe element 102, the flow path 222 includes the filler neck 210, which extends into the drillpipe element 102. Further, as with the embodiment illustrated in FIG. 3, the engagement pads 212 illustrated in FIG. 4 have not yet engaged with the outer circumferential area of the drillpipe element 102. However, once the pressurized seal is established to a desired degree, the engagement pads 112 may be actuated to radially engage an exterior of the drillpipe element 102 such that patterns or wickers 228 of the engagement pads 212 frictionally grip the drillpipe element 102, or more specifically the tool joint 116 portion of the drill pipe element 102.

Figure 5:
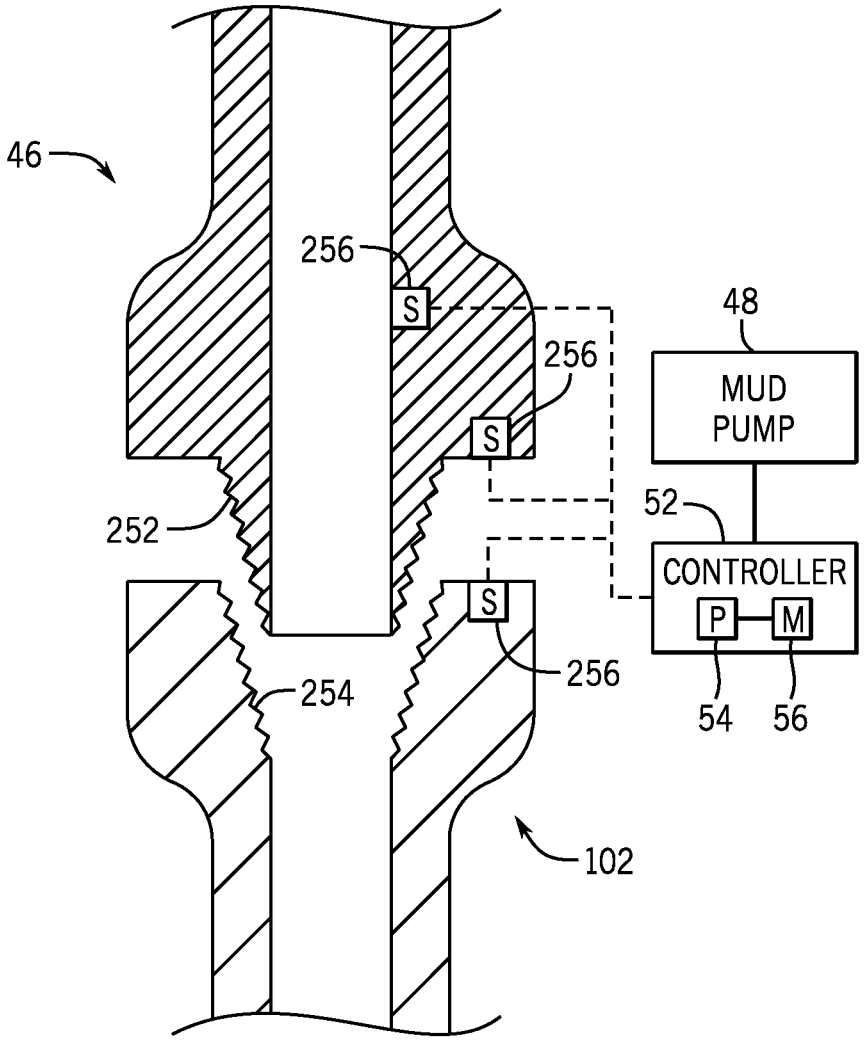
FIG. 5 is a schematic cross-sectional view of a gripping device and a drillpipe element in accordance with present techniques.

FIG. 5 is a schematic cross-sectional view of the top drive 46 in the process of being coupled with the drillpipe element 102 via a threaded engagement. More specifically, the top drive 46 has external threads 252 that correspond and engage with internal threads 254 of the drillpipe element 102. As similarly discussed above, top drive 46 may create a seal with the drillpipe element 102 to enable transfer of drilling mud to the drillpipe element 102, the drill string 28, and the wellbore 30. For example, drilling mud may be pumped and circulated during installation or removal of the drillpipe elements. As a result, installation and/or removal of the drillpipe elements may be improved (e.g., quickened). In the illustrated embodiment, the top drive 46 and the drillpipe element 102 also includes sensors 256 configured to monitor a connection between the top drive 46 and the drillpipe element 102. For example, the sensors 256 may include magnets, electrical contacts, optical sensors, pressure sensors, or other sensors configured to measure a distance and/or contact between the top drive 46 and the drillpipe element 102. In certain embodiments, the controller 52 may be configured to regulate operation of various components of the drilling rig 10 to enable a drilling mud flow through the top drive 46 and the drillpipe element 102 once sufficient contact between the top drive 46 and the drillpipe element 102 has been measured or detected by the sensors 256. For example, the controller 52 may regulate operation of the mud pump 48, a valve of the top drive 46 (e.g., valve 72 shown in FIG. 2), a valve disposed along the mud hose 50, or other component configured to enable a flow of drilling mud through the top drive 46 and the drillpipe element 102.

Figure 6:
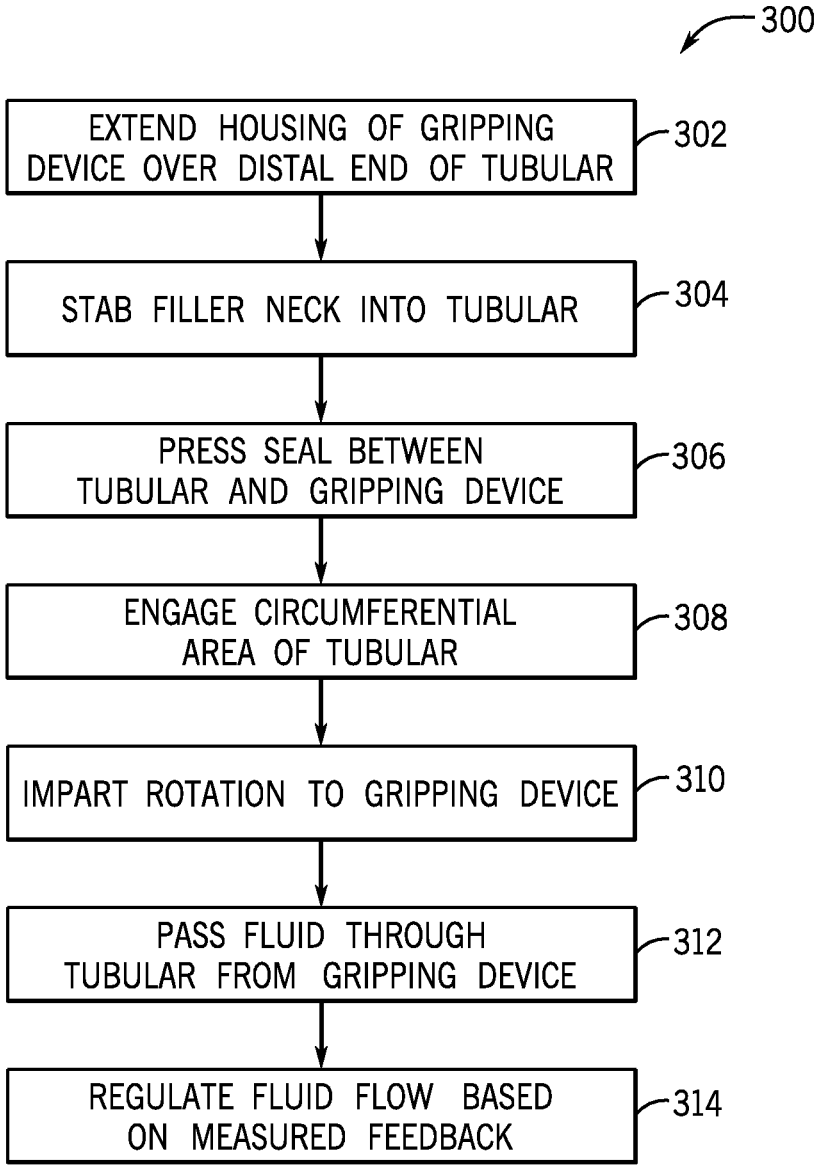
FIG. 6 is a process flow diagram of a method in accordance with present techniques.

FIG. 6 is a process flow diagram of a method of assembling or disassembling a drill string in accordance with present techniques. The method is generally indicated by reference numeral 300 and includes blocks that are representative of various steps or acts in the method 300. It should be noted that the various steps of the method 300 can be performed in the illustrated order or in a different order in accordance with present techniques. Further, in some instances, certain steps illustrated in FIG. 6 may be eliminated or additional steps may be performed.

As represented by block 302, the method 300 begins with extending a housing of a gripping device over a distal end of a drillpipe element such that a boundary of the housing extending from a perimeter of a face of the gripping device surrounds a circumferential area of the drillpipe element. As represented by block 304, this may result in stabbing a filler neck into the drillpipe element, wherein the filler neck extends from an inner perimeter of the face of the gripping device. Next, as represented by block 306, the method 300 includes pressing a seal between the face of the gripping device and a face of the drillpipe element. The seal may be integral with the gripping device or this may include the act of placing the seal between the gripping device and the drillpipe element. Further, block 308 represents engaging the circumferential area of the drillpipe element with an engagement feature of the gripping device. The step represented by block 308 may include hydraulically actuating gripping pads. Block 310 represents rotating the gripping device to impart rotation to the drillpipe element to facilitate attachment or detachment of the drillpipe element with a drill string. Further, block 312 represents passing fluid through the filler neck into the drill string. For example, fluid may be supplied by a mud pump, and operation of the mud pump, one or more valves, or other component may be regulated based on feedback from the drilling system, as indicated by block 314. The feedback may include measured operating parameters, such as a pressure or vacuum within the wellbore, a flow rate of the mud, a supply or retrieval rate of draw works drilling line, and so forth. By regulating the rate of fluid supplied through the tubular and into the wellbore, installation and removal of drillpipe components may be improved and optimized.

Figure 7:
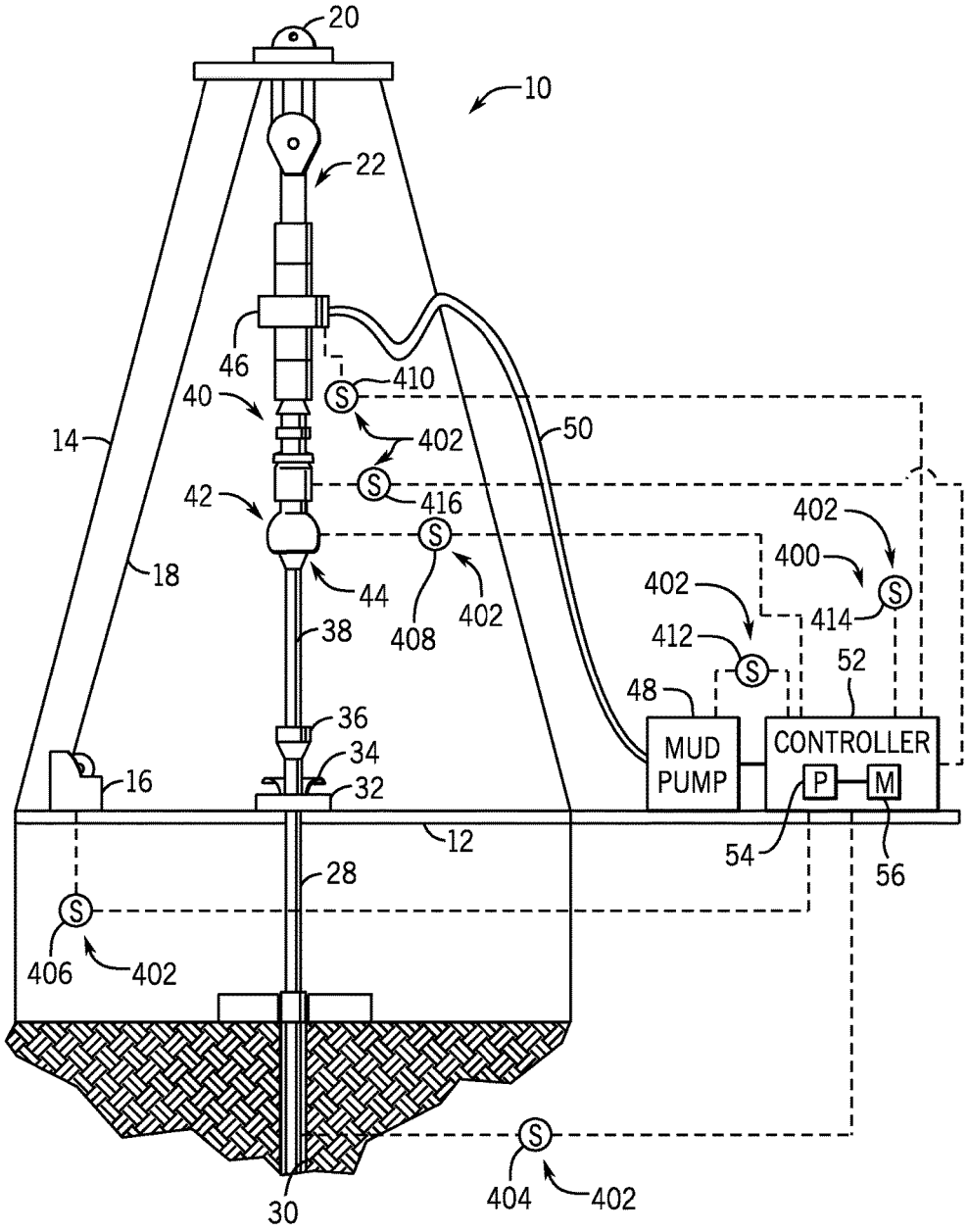
FIG. 7 is a schematic of a well being drilled in accordance with present techniques.

FIG. 7 is a schematic of the drilling rig 10, illustrating a control system 400 of the drilling rig 10. Specifically, the control system 400 is configured to regulate the flow of drilling mud or other drilling fluid into the drill string 28 and the wellbore 30 based on feedback collected by the control system 400. In the illustrated embodiment, the control system 400 includes sensors 402 configured to measure various operating and/or environmental parameters of the drilling rig 10.

The illustrated sensors 402 and indicated measured parameters are examples of feedback that may be used by the controller 52 to regulate the operation of the mud pump 48. However, it should be appreciated that the control system 400 may include other sensors 402 configured to measure other operating or environmental parameters of the drilling rig 10. For example, a first sensor 404 may be configured to measure a pressure within the wellbore 30, a vacuum within the wellbore 30, a gas level within the wellbore 30, a drilling mud flowrate within the wellbore 30, or other wellbore 30 parameter. A second sensor 406 may be configured to measure an operating parameter of the supply reel 16, such as a shaft speed of the supply reel 16, a supply speed of the drilling line 18, a retrieval speed of the drilling line 18, or other operating parameter of the supply reel 16. A third sensor 408 may be configured to measure a flow rate of drilling mud through the gripping device 42, a force (e.g., compressive force) of the gripping device 42 acting on the drillpipe 38, a pressure within the gripping device 42, or other parameter associated with the gripping device 42. A fourth sensor 410 may be configured to measure a parameter associated with the top drive 46, such as a rotational speed of the top drive 46. A fifth sensor 412 may be configured to measure an operating parameter related to the mud pump 48, such as a drive shaft speed of the mud pump 48, a compressive force of the mud pump 48, a flow rate of drilling mud through the mud pump 48, etc. A sixth sensor 414 may be configured to measure a parameter of the environment surrounding the drilling rig 10, such as an atmospheric pressure. A seventh sensor 416 may be configured to measure or monitor a valve position of a valve (e.g., valve 72 shown in FIG. 2) of the gripping device 42 or the pipe drive system 40. Each of the illustrated sensors may represent multiple sensors with redundant or different functionality. For example, the third sensor 408 may represent multiple sensors for monitoring flow rate, force between the gripping device 42 and the drillpipe 38, and pressure.

As will be appreciated, pumping and circulating drilling mud into the drill string 28 and wellbore 30 during installation and/or removal of drillpipe components may improve the drillpipe installation and/or removal process. In particular, the speed at which drillpipe components may be installed or removed may be increased. For example, when drillpipe components are removed from the wellbore 30, the volume of the drill string 28 removed from the wellbore 30 may be replaced by circulating drilling mud. As a result, vacuum pressures within the wellbore 30 may be reduced as the drillpipe components are removed from the wellbore 30. In certain embodiments, the drilling mud flow may be proportionally controlled so as to inject or circulate the drilling mud at a rate that is greater, less than, or equal to the volume of drillpipe 38 being removed from the wellbore 30.

Furthermore, as drillpipe components are removed from the wellbore 30 while drilling mud is circulated, the drillpipe 38 removed from the wellbore 30 may include a column of drilling mud. As such, when one or more sections of drillpipe 38 are removed from the wellbore 30, it may be desirable to flush or flow the drilling mud still within those sections of drillpipe 38 downwards into the wellbore 30 to prevent that drilling mud from flowing out onto the platform (e.g., rig floor 12) when the drillpipe 38 is disconnected from the drill string 28. Accordingly, in certain embodiments, the controller 52 may be configured to regulate operation of the mud pump 48 or one or more valves (e.g., valve 72 shown in FIG. 2) to increase the speed at which the drilling mud flows down the removed drillpipe 38 and into the drill string 28 remaining in the wellbore 30. For example, after one or more sections of drillpipe 38 is removed from the wellbore 30, the mud pump 48 may temporarily ramp up or increase the flow rate of drilling mud to provide additional momentum for flowing drilling mud down the drillpipe 38 and into the drill string 28 in the wellbore 30. In certain embodiments, one or more sensors 402 (e.g., position sensors, RF sensors, magnetic sensors, etc.) may be configured to detect when a section of drillpipe 38 is fully removed from the wellbore 30. In another embodiment, after one or more sections of drillpipe 38 is removed from the wellbore 30, the controller 52 may further open a valve and/or open additional valves (e.g., valve 72 shown in FIG. 2) of the drill pipe system 40 to increase drilling mud flow through the drillpipe 38. In other embodiments, atmospheric pressure or compressed air (e.g., from a compressed air source) may be used to force the column of drilling mud down the removed drillpipe 38.

Figure 8:
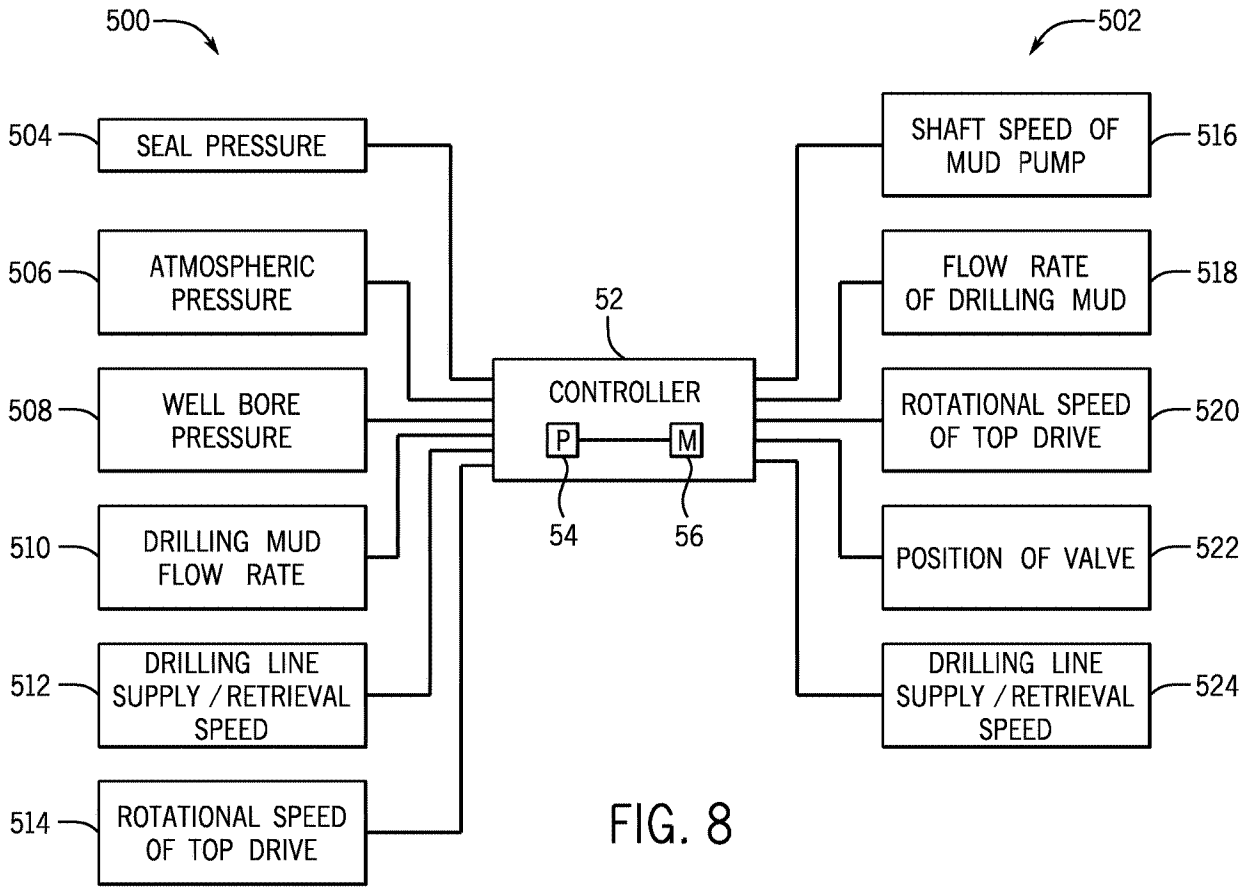
FIG. 8 is a schematic illustrating a controller with inputs and outputs of the controller in accordance with present techniques.

FIG. 8 is a schematic illustrating the controller 52 and various inputs 500 that may be monitored or utilized by the controller 52 along with various outputs 502 (e.g., operating commands) that the controller 52 may initiate based on one or more of the inputs 500. However, it should be noted that the inputs 500 and outputs 502 described below are merely exemplary, and other inputs and outputs are envisioned and within the scope of the present disclosure.

The inputs 500 represent various operating parameters of the drilling rig 10 and its components that may be monitored by the controller 52. Additionally, based on the values of one or more of the inputs 500, the controller 52 may regulate operation of one or more components of the drilling rig 10 (e.g., the mud pump 48, a valve, or other component). In other words, the outputs 502 are various commands or operations that the controller 52 may regulate based on one or more of the inputs 500. For example, in the illustrated embodiment, the inputs 500 include a seal pressure (e.g., pressure of a seal within the gripping device), as indicated by block 504, an atmospheric pressure, as indicated by block 506, a wellbore pressure, as indicated by block 508, a drilling mud flow rate, as indicated by block 510, a drilling line supply/retrieval speed, as indicated by block 512, and a rotational speed of the top drive, as indicated by block 514. Other inputs 500 (e.g., measured operating parameters of the drilling rig 10) are envisioned as well. In the illustrated embodiment, the outputs 502 include a shaft speed of the mud pump, as indicated by block 516, a flow rate of drilling mud, as indicated by block 518, a rotational speed of the top drive, as indicated by block 520, a position of a valve, as indicated by block 522, and a drilling line supply/retrieval speed, as indicated by block 524. Other outputs 502 (e.g., commands or regulated parameters/operations of the drilling rig 10) are envisioned as well.

As will be appreciated, one or more of the outputs 502 may be regulated by the controller 52 based on one or more of the inputs 500. In one embodiment, a position of a valve (block 522) configured to regulate flow of drilling mud may be regulated based on a seal pressure (block 504) of a seal within the gripping device 42 of the drilling rig 10. For example, when the seal pressure meets or exceeds a threshold level, the controller 52 may open the valve to enable drilling mud flow through the gripping device 42 and the drillpipe 38. In another embodiment, a drilling line retrieval speed (block 524) and a shaft speed of the mud pump 48 (block 516) may be controlled based on a wellbore pressure (block 508) of the wellbore 30. For example, if a measured pressure of the wellbore 30 is a vacuum pressure exceeding a threshold, the controller 52 may increase a shaft speed of the mud pump 48 to pump more drilling fluid into the wellbore 30, and the controller 52 may reduce the drilling line retrieval speed to reduce the speed at which the drillpipe 38 is removed from the wellbore 30. As will be appreciated, any combination of inputs 500 and outputs 502 (e.g., simultaneous inputs and simultaneous outputs) are within the scope of the present disclosure.

In certain embodiments, the controller 52 may be configured to pump drilling mud into the wellbore 30 at a rate proportional to a rate of removal of the drillpipe 38. In other words, the volume of drilling mud pumped into the wellbore 30 during a drill string 28 removal process may be proportional to the volume of drillpipe 38 removed from the wellbore 30. For example, for every unit of volume of drillpipe 38 removed from the wellbore 30, two units of volume of drilling mud may be simultaneously pumped into the wellbore 30. In this manner, vacuum pressures within the wellbore 30 may be reduced or eliminated during a drill string 28 removal process. In other embodiments, the volume of drilling mud pumped into the wellbore may be equal to or less than the volume of drillpipe 38 removed from the wellbore.

In some embodiments, rather than moving a drillpipe and/or a gripping device with respect to one another to achieve a sealing engagement between the drillpipe and gripping component, the gripping device may include features for holding the drillpipe in place and mechanically engaging a sealing feature of the gripping device with the drillpipe. For example, FIGS. 9 and 10 include a side view and a cross-sectional view, respectively, of a gripping device 1400 in the process of being coupled with the drillpipe element 102 in accordance with embodiments of the present technique. It should be noted that the cross-sectional view presented in FIG. 10 is taken along line 9A-9A of FIG. 9, which is essentially along a rotational axis of the gripping device 1400. In particular, FIGS. 9 and 10 may represent the drillpipe element 102 being lifted into engagement with the gripping device 1400 or the gripping device 1400 being lowered over the drillpipe element 102. The gripping device 1400 includes various pipe gripping features and a hydraulically energized piston that moves within the gripping device 1400 and seals against the drillpipe element 102, as will be discussed in detail below. As in FIGS. 3 and 4, the drillpipe element 102 includes the drillpipe body 114, the tool joint 116, the threads 118, and the drillpipe face 119. The drillpipe element 102 may simply be representative of a tubular element and present embodiments may be configured to couple with other tubular elements.

Figure 9:
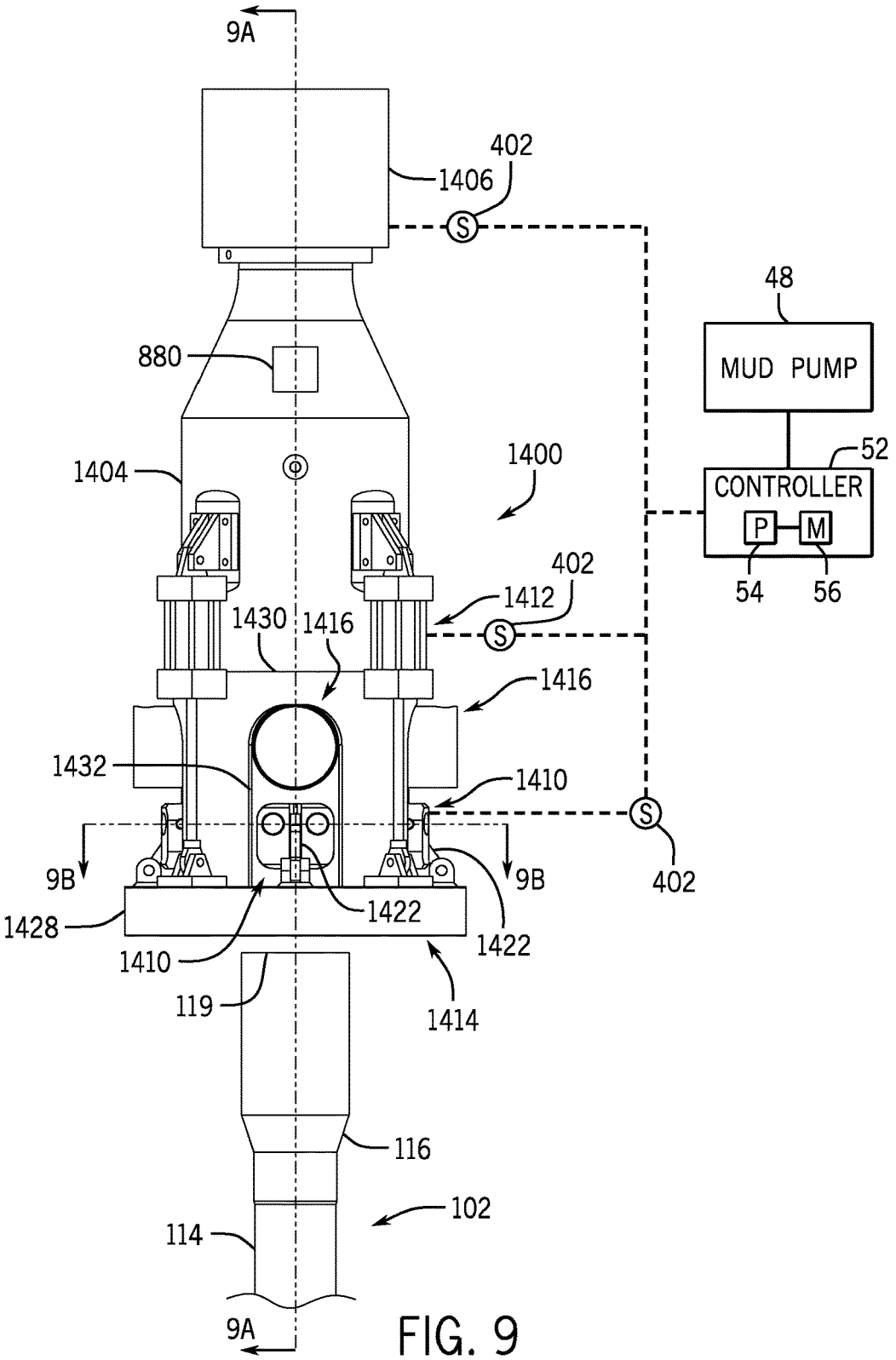
FIG. 9 is a side view of a gripping device and a drillpipe element, wherein the gripping device is in a retracted orientation in accordance with present techniques.
Figure 10:
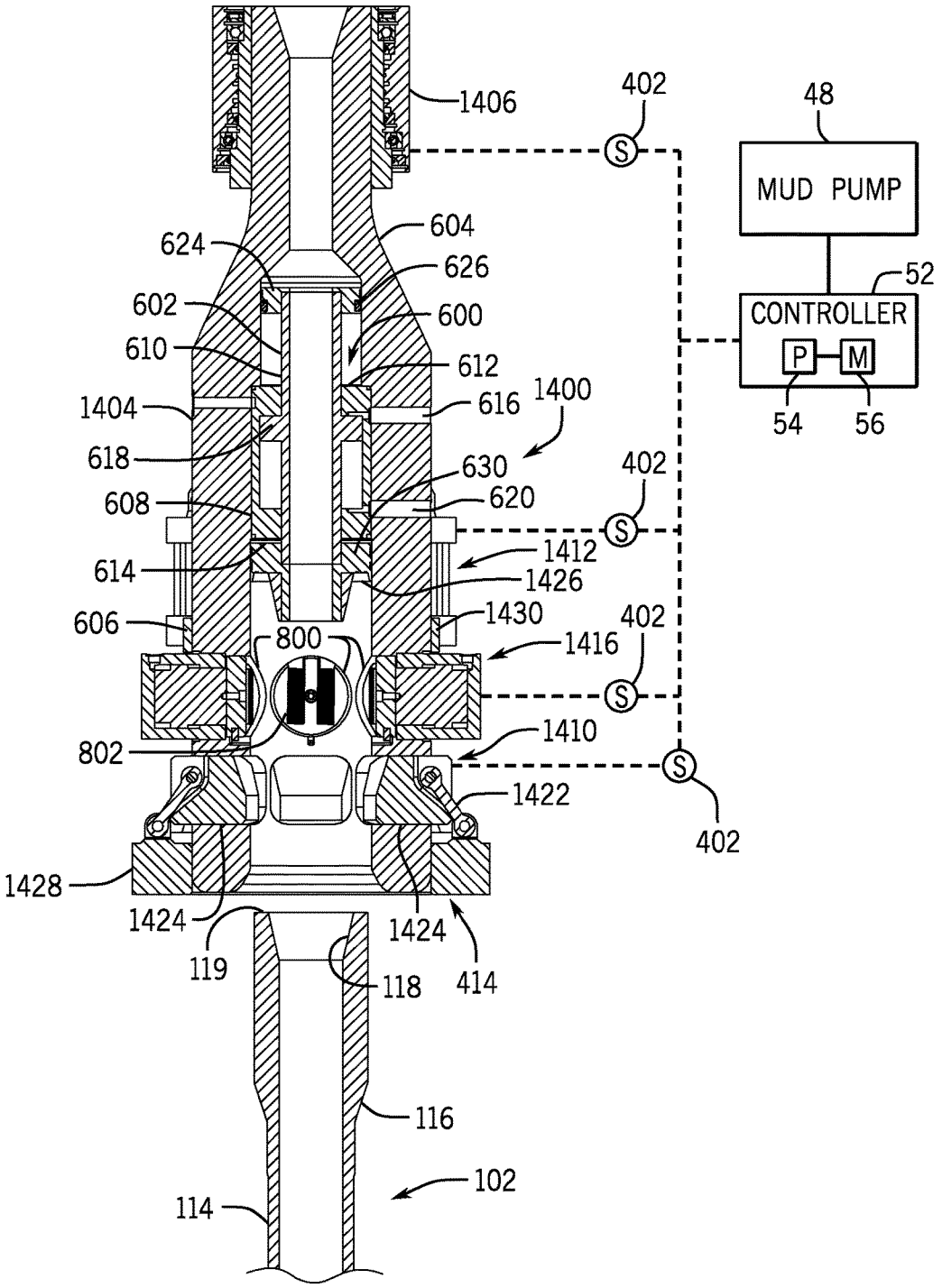
FIG. 10 is a cross-sectional view of the gripping device and drillpipe element of FIG. 9 taken along line 9A-9A in accordance with present techniques.

In the embodiment illustrated by FIGS. 9 and 10, the gripping device 1400 includes various features that are at least partially visible from the outside of the gripping device 1400. Specifically, for example, the gripping device 1400 includes a main body or housing 1404, a hydraulic rotary seal 1406 coupled about an end of the housing 1404, elevators 1410, elevator actuators 1412, an elevator support or lock 1414, and torsional clamping actuators 1416. As will be discussed below, these features cooperate together to facilitate surrounding a distal end of the drillpipe element 102, vertically securing the drillpipe element 102 within the gripping device 1400, creating a sealed engagement between the gripping device 1400 and the drillpipe element 102, centralizing the drillpipe element 102 within the gripping device 1400, and applying torque to the drillpipe element 102 via the gripping device 1400. The manner in which these features may function will be discussed in detail below.

Present embodiments are directed to establishing an engagement between the gripping device 1400 and the drillpipe element 102 that can support a pulling load, a torsional load, and a fluid seal (e.g., mud seal). An initial aspect of establishing such an engagement between the drillpipe element 102 and the gripping device 1400 includes engaging the tool joint 116 with the elevators 1410 to support a pulling load. In some embodiments, this includes positioning the tool joint 116 within the gripping device 1400. For example, in the illustrated embodiment, the elevators 1410 are integral with the gripping device 1400. However, in other embodiments, separate elevator features may be used along with a linkage or the like to secure the drillpipe element 102 with respect to a gripping device in accordance with present embodiments.

In the illustrated embodiment, the elevators 1410 include links 1422 and elevator blocks 1424. The links 1422 translate vertical motion into horizontal or radial motion and the elevator blocks 1424 function to engage and secure the drill pipe element 102 within the gripping device 1400. Specifically, as the elevator support 1414 moves up or down relative to the housing 1404, the corresponding movement of the elevators 1410 causes the links 1422 to push or pull the elevator blocks 1424 through openings in the housing 1404 such that the elevator blocks 1424 (FIG. 10) can engage or disengage the tool joint 116. As can be more readily observed in FIG. 10, the actuation state of the gripping device 1400 illustrated in FIGS. 9 and 10 includes the elevator blocks 1424 in a retracted position. Indeed, the elevator blocks 1424 are generally retracted outside of the internal diameter of the housing 1404. When the elevator blocks 1424 are in this retracted position, the drillpipe 102 can readily slide past the elevator blocks 1424 into the housing 1404. When the elevator blocks 1424 are in the engaged position, the elevator blocks 1424 engage the tool joint 116. More specifically, the elevator blocks 1424 engage the upset or conical portion of the tool joint 116, which enables support of the pulling load by the gripping device 1400 without creating a threaded engagement between the threads 118 and any feature of the gripping device 1400.

When initially coupling the drillpipe 102 and the gripping device 1400, the drillpipe 102 and gripping device 1400 may first be engaged such that the tool joint 116 is positioned within the gripping device 1400 and positioned beyond the elevator blocks 1424 to some degree. Once the tool joint 116 has generally progressed beyond edges of the elevator blocks 1424, the elevator actuators 1412 may actuate the elevators 1410 to engage the elevator blocks 1424 with the drillpipe 1424. For example, to establish proper alignment of the elevator blocks 1424 and the tool joint 116, the drillpipe face 119 and a seal face 1426 within the housing 1404 may be slid into engagement. The seal face 1426 may be arranged within the housing 1404 based on standard tool joint sizes such that engagement of the drillpipe face 119 with the seal face 1426 ensures that the tool joint 116 is properly positioned with respect to the elevator blocks 1424 before activation of the elevators 1410. Once a desired positioning is achieved, the elevators 1410 may be actuated to engage the tool joint 116 and thus establish vertical or pulling support of the drillpipe 102 by the gripping device 1400.

The elevator actuators 1412 may include hydraulically actuated cylinders that may be activated to move the elevator support 1414 toward the hydraulic rotary seal 1404 and, in turn, actuate the elevators 1410. In the illustrated embodiment, the elevator support 1414 includes a base ring 1428 and a sleeve 1430 that is disposed around the outer perimeter of housing 1404. The sleeve 1430 provides support and includes slots 1432 to facilitate movement of the sleeve 1430 about the portions of the elevators 1410 and torsional clamping actuators 1416 that extend from the perimeter of the housing 1404. The base ring 1428 provides a base for attachment of the links 1422 and operates as a locking feature when the elevators 1410 are fully engaged. In the illustrated embodiment, the elevator actuators 1412 are configured to cause the elevator support 1414 to move upward toward the hydraulic rotary seal 1406. When the elevator support 1414 moves up, a portion of the links 1422 attached to the base ring 1428 are moved upward as well, which causes the links 1422 to push the elevator blocks 1424 through openings in the housing 1404 into an extended or engaged orientation. When the drillpipe 102 is properly positioned within the gripping device 1400, putting the elevators 1410 in the extended orientation results in engagement of the elevator blocks 1424 with the tool joint 116.

Figure 11:
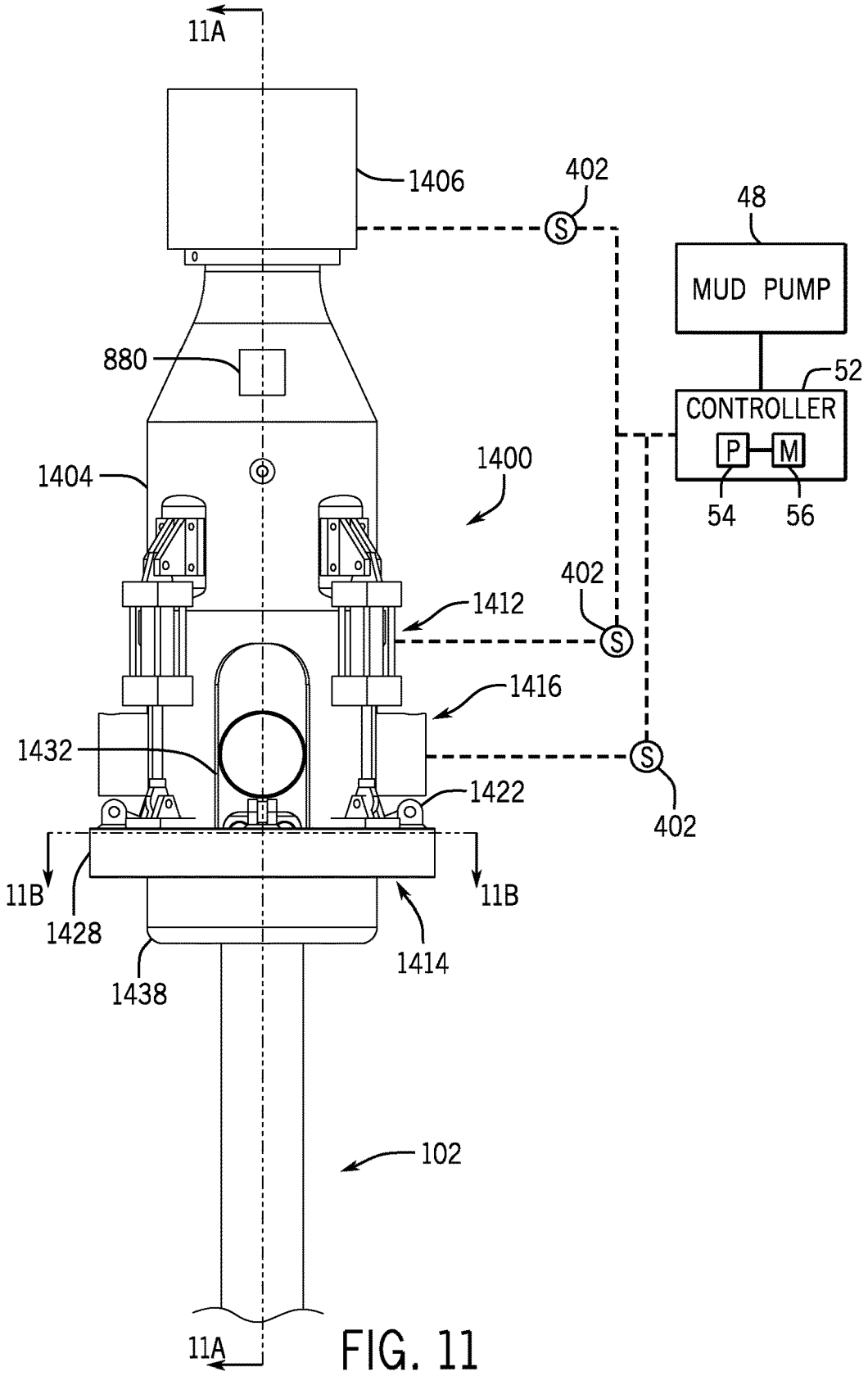
FIG. 11 is a side view of a gripping device and a drillpipe element, wherein the gripping device is in an engaged orientation in accordance with present techniques.
Figure 12:
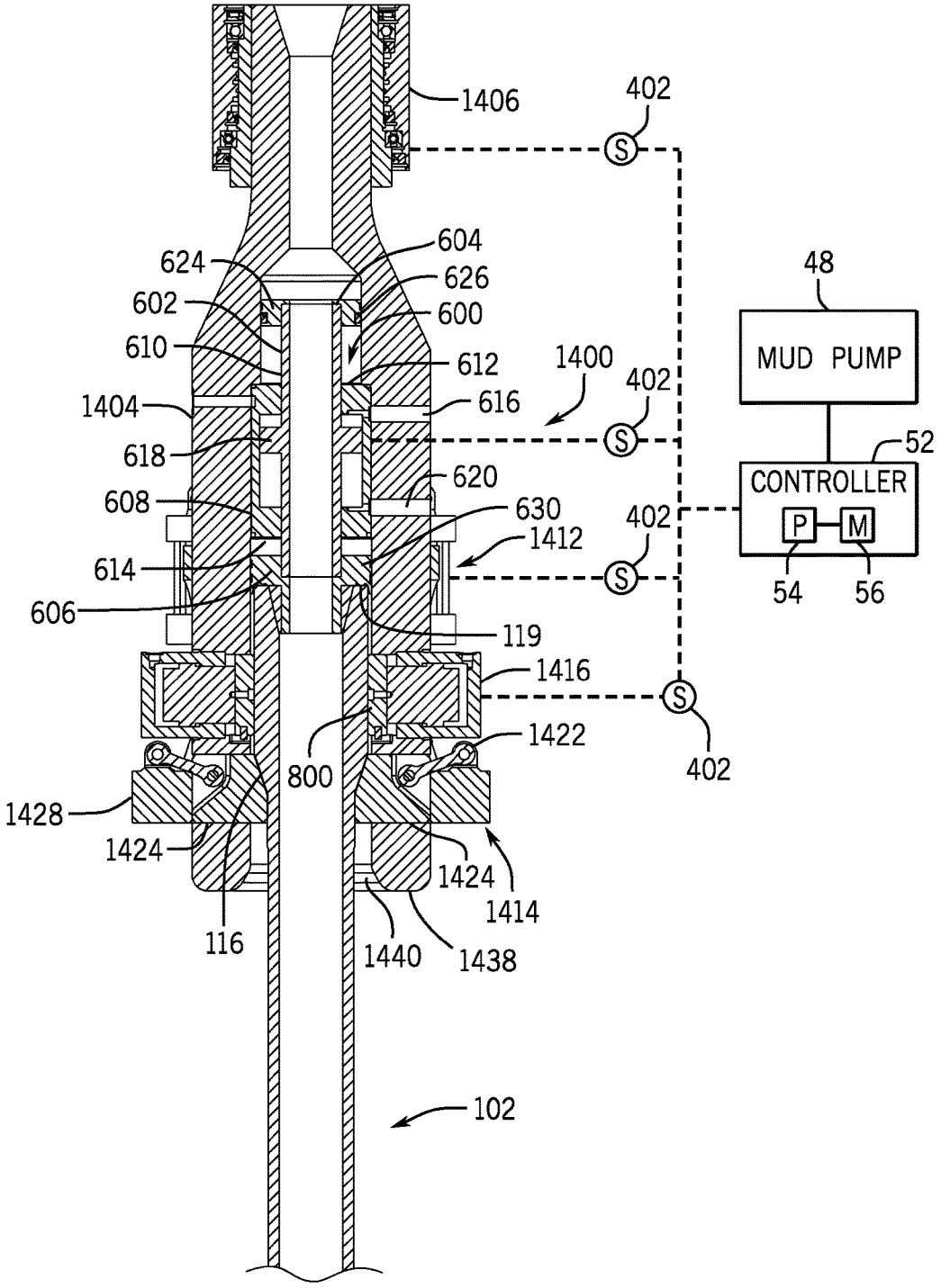
FIG. 12 is a cross-sectional view of the gripping device and drillpipe element of FIG. 11 taken along line 11A-11A in accordance with present techniques.

The extended or engaged orientation of the elevators 1410 is illustrated in FIGS. 11 and 12, which include a side view and a cross-sectional view, respectively, of the gripping device 1400 while engaged with the drillpipe element 102. FIG. 12 is a cross-sectional view of the gripping device 1400 taken along line 11A-11A in FIG. 11. As shown in FIG. 11, the elevator support 1414 has been moved upward along the housing 1404 toward the hydraulic rotary seal 1406. The movement of the elevator support 1414 with respect to the housing is evidenced by the change in position of the slots 1432 with respect to the torsional clamping actuators 1416 and the exposure of a lower lip 1438 of the housing 1404 (which includes an internal taper 1440 to facilitate insertion of the drillpipe element 102). Further, this repositioning of the elevator support 1414 results in the base ring 1428 of the elevator support 1414 being positioned around the elevator blocks 1424 such that the base ring 1428 retains the elevator blocks 1424 in the extended position within the internal diameter of the housing 1404. Thus, when the gripping device 1400 is coupled with the drillpipe element 102, the base ring 1428 keeps the elevators 1410 engaged and prevents dropping the drillpipe element 102.

Figure 13:
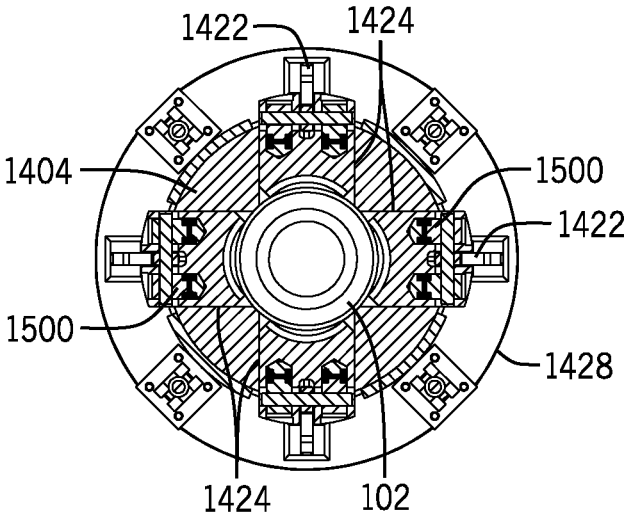
FIG. 13 is a cross-sectional view of the gripping device of FIG. 9 taken along line 9B-9B in accordance with present techniques.
Figure 14:
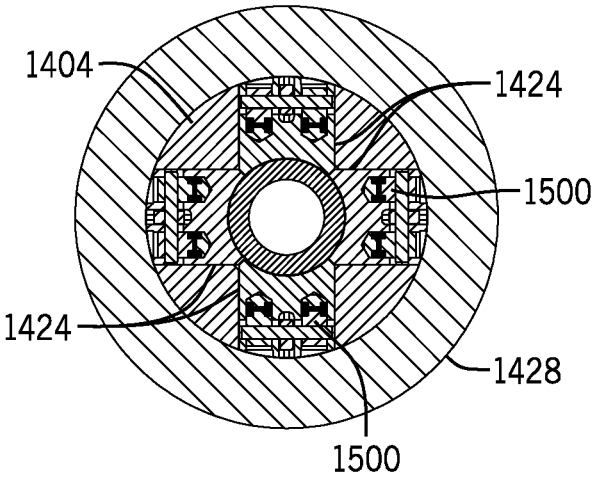
FIG. 14 is a cross-sectional view of the gripping device and drillpipe element of FIG. 11 taken along line 11B-11B in accordance with present techniques.

FIGS. 13 and 14 are cross-sectional views of the gripping device 1400 taken along lines 9B-9B and 11B-11B, respectively. Each of these cross-sectional views are taken along lines passing through the elevators 1410 and show the transition of the elevators 1410 with respect to the gripping device 1400 being in an open configuration (FIG. 13) and in an engaged configuration (FIG. 14). The inside diameter of the housing 1404 is essentially unencumbered in FIG. 13 because the elevator blocks 1424 are in a retracted position, while the elevator blocks 1424 are partially positioned within the inside diameter of the housing 1404 and are engaged with the drillpipe element 102 in the engaged configuration of FIG. 14. Further, in FIG. 13, the base ring 1428 is shown below the elevator blocks 1424 because the elevator support 1414 has not yet been raised into a position surrounding the elevator blocks 1424, while FIG. 14 shows the base ring 1428 aligned with the elevator blocks 1424. It should also be noted that biasing mechanisms 1500 of the elevators 1410 are visible in each of the cross-sectional views provided by FIGS. 13 and 14. As will be discussed in detail below, these biasing mechanisms 1500 may facilitate proper positioning of the elevator blocks 1424 for engagement of the drillpipe element 102 and maintaining engagement between the gripping device 1400 and the drill pipe element 102 under certain conditions.

As noted above, present embodiments may include features configured to maintain engagement of the elevator blocks 1424 with the drillpipe element 102 (e.g., via the tool joint 116). Even in embodiments wherein the elevator actuators 1412 require activation (e.g., via application of hydraulic pressure) to actuate the elevators 1410, present embodiments may prevent the loss of activation energy (e.g., loss of hydraulic pressure) from causing the elevators 1410 to disengage the drillpipe element 102. For example, the elevators 1410 and the base ring 1428 of the elevator support 1414 may cooperate in an engaged orientation of the gripping device 1400 to maintain coupling with the drillpipe element 102. Such cooperation is illustrated in FIG. 15, which includes a cross-sectional view of the elevator 1410 including the biasing mechanism 1500, wherein the elevator block 1424 is aligned with and positioned inside of the base ring 1428.

Figure 15:
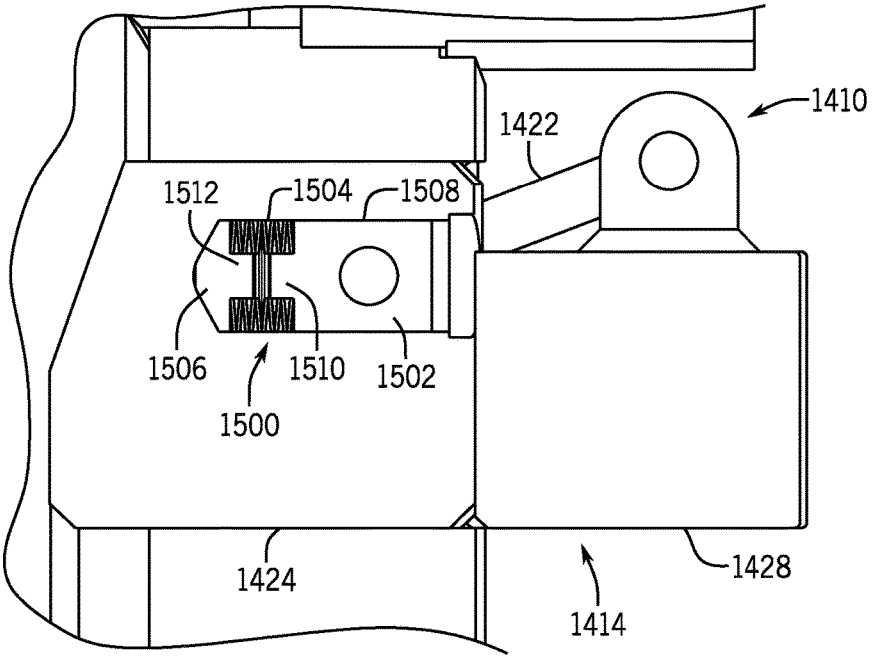
FIG. 15 is a cross-sectional view of an elevator and a portion of an elevator support in accordance with present techniques.

In the illustrated embodiment of FIG. 15, the biasing mechanism 1500 includes a plunger 1502, a spring 1504, and a spring seat 1506 disposed within a receptacle 1508 of the elevator block 1424. The plunger 1502 is coupled to the link 1422 in a hinged fashion and the spring 1504 is positioned between the plunger 1502 and the spring seat 1506, which is positioned in the end of the receptacle 1508. Specifically, the spring 1504 is positioned about a boss 1510 on the plunger 1502 and about a boss 1512 on the spring seat 1506. In the illustrated position, the spring 1504 is generally biasing the plunger 1502 away from the spring seat 1506. The spring 1504 may be calibrated such that pressure applied via the elevator actuators 1412 can overcome a bias of the spring 1504 and allow disengagement of the elevator 1410. Specifically, the elevator actuators 1412 may be activated to cause the elevator support 1414 to move downward from the position illustrated in FIG. 15, which results in an initial pushing of the plunger 1502 toward the spring seat 1506 by the link 1422. Indeed, the pressure on the plunger 1502 may be sufficient to overcome the bias of the spring 1504 and compress the spring 1504 the distance between the boss 1510 and the boss 1512. Once the spring 1504 has been sufficiently compressed to allow the link 1422 a sufficient range of motion, the base ring 1428 can move down and out of alignment with the elevator block 1424. This allows activation of the elevator actuators 1412 to disengage the gripping device 1400 from the drillpipe element 102. However, the spring 1504 may also be calibrated such that losing power to the elevator actuators 1412, in embodiments that require activation of the elevator actuators 1412 to engage the elevator 1410, will not result in disengagement of the elevator 1410. For example, if the elevator actuators 1412 include hydraulic actuators, the spring 1504 may be calibrated such that a force applied by the weight of certain components when hydraulic pressure is lost would not be sufficient to overcome the spring 1504 and compress it the distance that allows the link 1422 to rotate such that the base ring 1428 is not blocking the elevator block 1424 from retracting from engagement with the drillpipe element 102.

As noted above, present embodiments are directed to establishing an engagement between the gripping device 1400 and the drillpipe element 102 that can support a pulling load, a torsional load, and a fluid seal (e.g., mud seal). As indicated above, an initial aspect of establishing such an engagement between the drillpipe element 102 and the gripping device 1400 includes engaging the tool joint 116 with the elevators 1410 to support the pulling load. After establishing the pulling support with the elevators 1410 (or separate elevators), present embodiments include establishing a fluid seal between the gripping device 1400 and the drillpipe element 102. Such a seal may be established by a sealing mechanism 600 that shifts sealing components of the sealing mechanism 600 into engagement with the drillpipe face 119 and/or the threads 118. By establishing the seal in accordance with present embodiments, the drillpipe 102 may also be aligned with the gripping device 1400 for facilitating later establishment of engagement for torsional load.

In the illustrated embodiment of FIGS. 10 and 12, the sealing mechanism 600 includes a seal piston 602, an upper seal 604 coupled to an upper portion of the seal piston 602, a lower seal 606 coupled with a lower portion of the seal piston 602, and a piston housing 608 that is coupled with the housing 1404. In the illustrated embodiment, the seal piston 602 includes a hollow, double rod, double acting piston. The seal piston 602 generally includes an elongate hollow body 610 that extends through the piston housing 608, which essentially functions a component of an actuator for the seal piston 602. Indeed, an upper end of the seal piston 602 extends through an upper opening 612 in the piston housing 608 and a lower end of the piston 602 extends through a lower opening 614 in the piston housing 608. Accordingly, the seal piston 602 can slide the lower seal 606 downward into engagement with the drillpipe element 102.

The seal piston 602 may be actuated by pressure. For example, an actuator may provide hydraulic pressure via an upper port 616 into the piston housing 608 such that pressure is increased on an upper side of a lip 618 of the seal piston 602 within the piston housing 608. This may force the seal piston 602 downward and correspondingly flush fluid out of a second port 620 accessing the piston housing 608 that is below the lip 618. In turn, this actuation of the seal piston 602 may cause the lower seal 606 to move relative to the housing 1404 and to engage a drillpipe element 102 positioned in the gripping device 1400. This type of actuation is illustrated by the transition shown between FIGS. 10 and 12. In FIG. 10, the seal piston 602 has not been positioned for engagement (e.g., no hydraulic pressure has been applied above the lip 618). In FIG. 12, the seal piston 602 has been positioned downward relative to the position shown in FIG. 10 and the lower seal 606 is engaging the drillpipe element 102.

Pressure may also be applied to the seal piston 602 by fluid (e.g., mud) passing through the gripping device 1400 to the drillpipe element 102. Specifically, for example, mud coming from above the gripping device 1400 may press on the upper seal 604. Pressure on the upper seal 604 may not be sufficient pressure to actuate the seal piston 602 in some embodiments. However, it may serve to preload the seal piston 602 for actuation by a separate actuator (e.g., a hydraulic actuator). Further, because the surface of the upper seal 604 exposed to pressure from fluid is larger than the surface of the lower seal 606 exposed to pressure from fluid, the seal piston 602 will generally be energized downward under fluid pressure (e.g., mud pressure). This may force the lower seal 606 against the drillpipe element 102 to prevent leakage in the event that an actuator for the seal piston 602, such as a hydraulic actuator, loses energy (e.g., pressure).

The upper seal 604 and the lower seal 606 may be integral with or attachable with the seal piston 602. Further, the upper seal 604 and the lower seal 606 may include numerous different seal features and combinations of seal features in accordance with present embodiments. The upper seal 604 illustrated in FIGS. 10 and 12 includes a main body 624 that is coupled about an outer perimeter of the seal piston 602 and a hydraulic rod lip seal 626 integrated with or installed in the main body 624. The lower seal 606 illustrated in FIGS. 10 and 12 includes a main body 630 coupled about an outer perimeter of the seal piston 602 and a pair of O-rings (FIG. 16) integrated with or installed in the main body 630 that are arranged to engage the drillpipe face 119. In some embodiments, one or more O-rings may be employed to create a labyrinth. Further, the O-rings may include commercially available O-rings and may be made of any of various different materials (e.g., rubber, metal, plastic, or nitrile).

Figure 16:
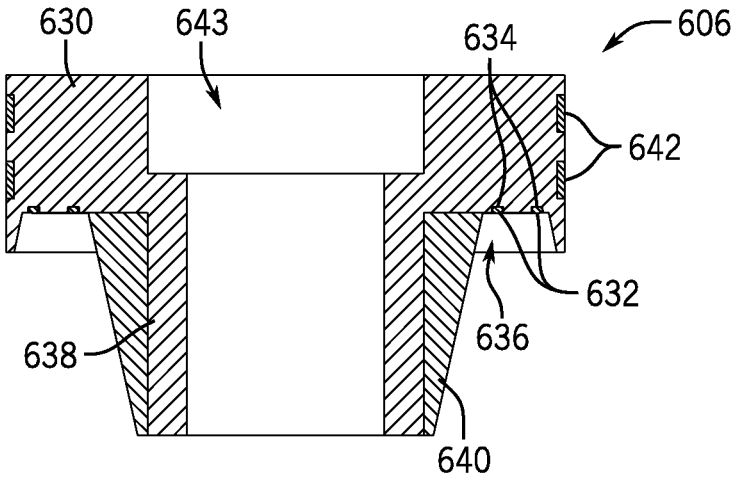
FIGS. 16-21 are cross-sectional views of seal features in accordance with present techniques.

Certain features of the lower seal 606 are more clearly illustrated in FIG. 16, which is a cross-sectional view of the lower seal 606. As shown in FIG. 16, the main body 630 includes the O-rings 632 disposed within grooves 634 in the main body 630 and a larger groove 636 for receiving the drillpipe element 102. The main body 630 also includes a neck portion 638 that is configured to extend within the drillpipe element 102 when the lower seal 606 engages the drillpipe element 102. Disposed about the neck portion 638 is a thread engaging feature 640 for engaging and protecting the threads 118. The thread engaging feature 640 may be made of any suitable material (e.g., urethane, steel, or brass). In the illustrated embodiment, the thread engaging feature 640 is generally frustum-shaped to facilitate engagement and alignment with the drillpipe element 102. In some embodiments, the neck portion 638 itself may be frustum-shaped or the thread engaging feature 640 may be an integral portion of the main body 630. Further, the thread engaging feature 640 may be any of various different shapes or completely absent in certain embodiments. It should be noted that the illustrated thread engaging feature 640 does not create a threaded coupling or engagement with the threads 118. As shown in FIG. 16, the lower seal 606 also includes alignment guides 642, which may be formed of a material such as Teflon. Further, the lower seal 606 in the embodiment illustrated by FIG. 16 includes a threaded receptacle 643 for coupling with the seal piston 602.

Figure 17:
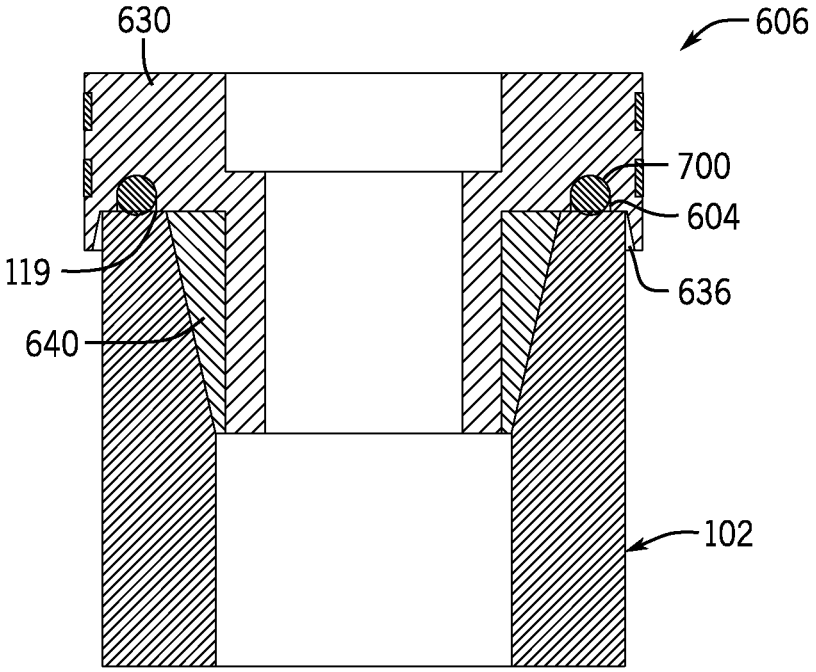
Figure 18:
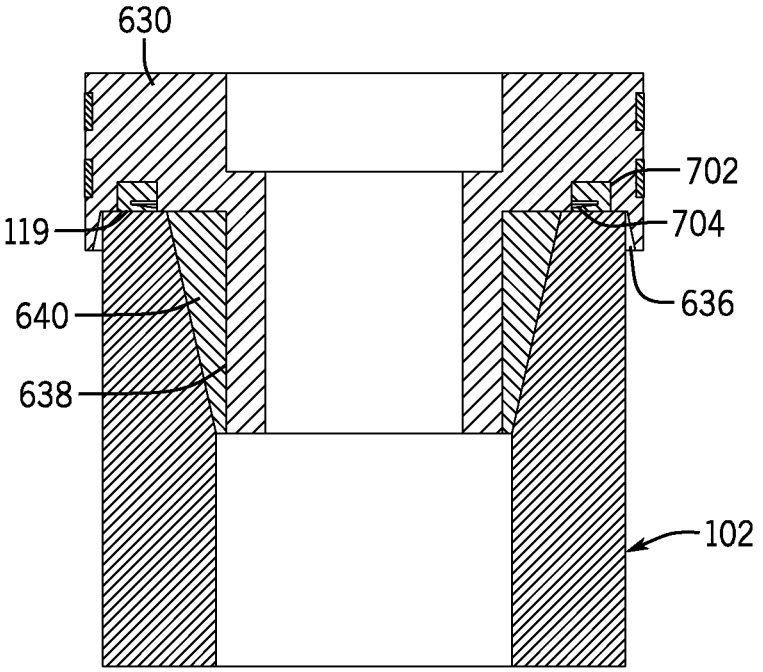

It should be noted that numerous different seal features could be employed in accordance with present embodiments. For example, FIGS. 17-21 include various examples of seals that may be employed as the lower seal 606. Any combination of the seal features illustrated in FIGS. 17-21 may be utilized in the lower seal 606 and/or portions may be utilized in the upper seal 604. Specifically, turning to the examples provided in FIGS. 17-21, the lower seal 606 illustrated in FIG. 17 includes a single crush O-ring 700 engaged within a single groove 604 in the main body 630 and generally being crushed between the drillpipe face 119 and the main body 630 to establish a seal. The embodiment illustrated in FIG. 18 is similar to that of FIG. 17 with the crush O-ring 700 replaced by a hydraulic face lip seal 702, which includes a lip portion 704 that allows pressure to get inside to generate a seal.

Figure 19:
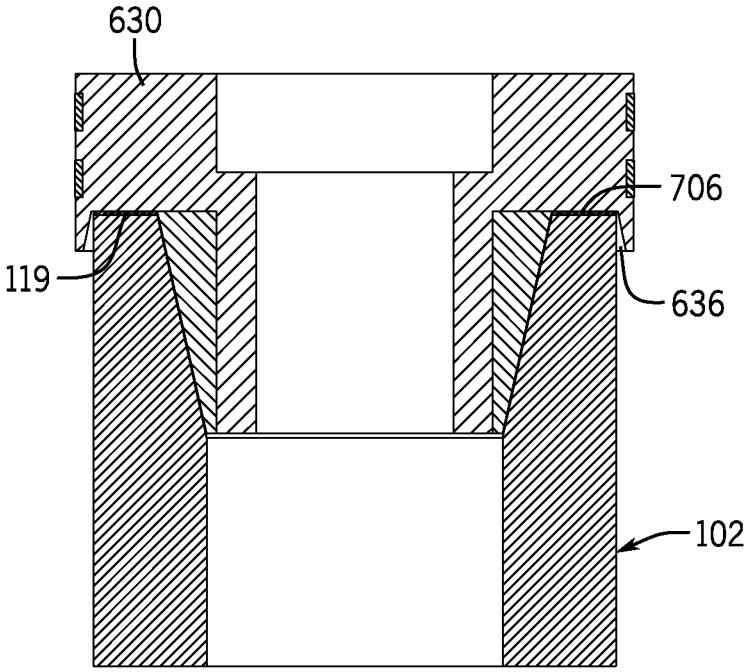

In the embodiment illustrated by FIG. 19, a crush gasket 706 (e.g., an aluminum, copper, or rubber gasket) is positioned between the drillpipe face 119 and the main body 630 within the groove 636 to create a seal. In some embodiments, the crush gasket 706 may represent pipe dope. Further, in some embodiments, the pipe dope may be injected with an automated injection system (e.g., a pump and tubing integral with the gripping device 1400 and configured to inject pipe dope in the groove 636).

Figure 20:
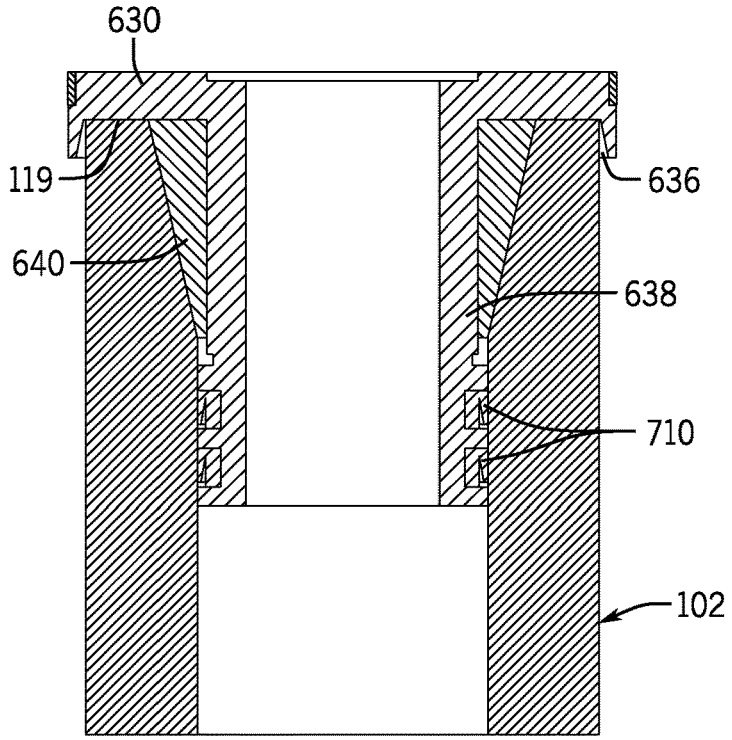
Figure 21:
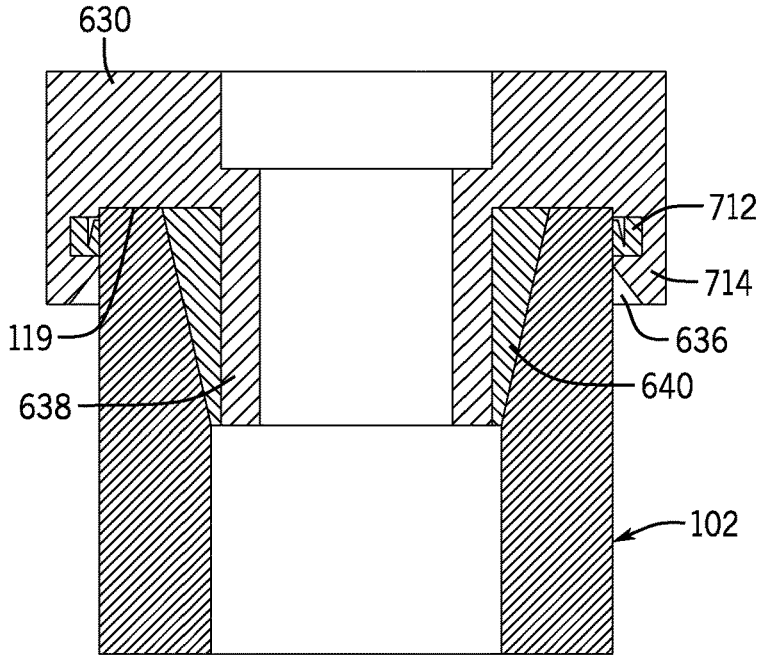

FIGS. 20 and 21 illustrate seal features that specifically engage the drillpipe 102 at locations other than at the drillpipe face 119. The embodiment illustrated by FIG. 20 includes a neck portion 638 that extends beyond the thread engaging feature 640 and includes hydraulic piston lip seals 710 arranged to engage the inside diameter of the drillpipe 102. The embodiment illustrated by FIG. 21 includes a hydraulic rod lip seal 712 positioned in a groove within a lip 714 of the main body 630 such that the hydraulic rod lip seal 712 is configured to engage an outer diameter of the drillpipe 102. As noted above, the features illustrated in FIGS. 16-21 may be included in any combination to facilitate establishing a seal between the gripping device 1400 and the drillpipe element 102.

Again, present embodiments are directed to establishing an engagement between the gripping device 1400 and the drillpipe element 102 that can support a pulling load, a torsional load, and a fluid seal. Establishing support for a pulling load has been discussed above with respect to the elevators 1410. Further, establishing a fluid seal has been discussed above with respect to the sealing mechanism 600. By establishing the seal in accordance with present embodiments, the drillpipe 102 may also be aligned with the gripping device 1400 to facilitate establishing engagement for supporting torsional load. Support for the torsional load may be provided by activating the torsional clamping actuators 1416 (e.g., hydraulic cylinders), which are configured to actuate frictional engagement features 800, as illustrated in FIGS. 10 and 12, into engagement with the drillpipe element 102. FIG. 10 illustrates the frictional engagement features 800 in a disengaged position and FIG. 12 illustrates the frictional engagement features 800 in an engaged position. This aspect of the gripping device 1400 operates in a fashion similar to a grabber box.

In the illustrated embodiment, the frictional engagement features 800 include die clamps 802 (torsional pipe clamps) that are configured to be activated by the torsional clamping actuators 1416 to radially engage the drillpipe element 102 when it is disposed within the housing 1404 and aligned with the engagement features 800. The frictional engagement features 800 and torsional clamping actuators 1416 may generally be referred to together as torsional clamp devices. Once the frictional engagement features 800 are sufficiently engaging the drillpipe element 102, torque can be transferred from the gripping device 1400 to the drillpipe element 102 via the frictional engagement features 800. It should also be noted that the torsional clamping actuators 1416 may include hydraulic actuators with counter balance valves and/or valving configurations to resist pressure loss and ensure that a sufficient engagement is maintained between the frictional engagement features 800 and the drillpipe element 102 even when there is a loss of actuation energy (e.g., pressure leakage or loss of power).

As illustrated in FIGS. 9 and 11, the gripping device 1400 may include a control feature 880 in accordance with present embodiments. The illustrated control feature 880 may be representative of one or more devices configured to facilitate monitoring and/or control of certain operational features of the gripping device 1400. The control feature 880 may include a processor and integral sensors. In some embodiments, the control feature may be configured to cooperate with external sensors to detect certain operational characteristics. In the illustrated embodiment, the control feature 880 is centrally located and detects sensor readings from sensors (e.g., sensors 72) throughout the gripping device 1400. However, in some embodiments, the control feature 880 may include multiple devices that are located proximate sensors throughout the gripping device 1400. In certain embodiments, the control feature 880 may be separate from the controller 52 described above, or the control feature 880 may be integrated with the controller 52 described above.

As described in detail above, present embodiments are directed towards to systems and methods for circulating mud or other fluid within the wellbore 30 during insertion and/or removal of drillpipe elements (e.g., sections of drillpipe 38) into and out of the wellbore 30. For example, the pipe drive system 40 may be configured to create a seal between the drillpipe handling equipment (e.g., gripping device 1400) and the drillpipe 38 such that fluid can efficiently pass from the pipe drive system 40 into the drillpipe 38, the drill string 28, and the wellbore 30. The flow of drilling mud or other fluid through the drillpipe 38 and within the wellbore 30 may be controlled and regulated by a control system 400 (e.g., controller 52 and sensors 402), during insertion or removal of the drillpipe 38. For example, the flow of mud or other fluid may be based on measured feedback or operating parameters associated with the insertion and/or removal of the drillpipe 38. In the embodiment shown in FIG. 9, the controller 52 may be configured to regulate a flow of drilling mud through the gripping device 1400 and the drillpipe element 102 based on feedback from sensors 402. FIGS. 10-12 show similar configurations of the controller 52 and the sensors 402. The sensors 402 in the embodiment shown in FIGS. 9-12 are configured to measure one or more operating parameters associated with operation of the gripping device 1400. For example, one or more of the sensors 402 may be configured to measure and/or monitor operation (e.g., an operating parameter) of the elevators 1410, a pressure or position of the hydraulic rotary seal 1406, operation (e.g., an operating parameter) of the elevator actuators 1412, or other operating parameter of the gripping device 1400. The sensors 402 may include position sensors, magnetic sensors, electrical sensors, pressure sensors, flow meters, or other suitable sensors for measuring operating parameters of the gripping device 1400 and its components. Based on the measurements (e.g., feedback) collected by the sensors 402, the controller 52 may regulate a drilling fluid (e.g., drilling mud) flow through the gripping device 1400 and into the drillpipe element 102 and the wellbore 30. For example, the controller 52 may regulate operation of the mud pump 48, a valve (e.g., valve 70 shown in FIG. 2) of the gripping device 1400 configured to regulate flow of drilling mud, or other component of the gripping device 1400.

The control feature 880 may be representative of any number of devices capable of monitoring relevant drilling parameters. The monitored drilling parameters may include drill string speed and rotational orientation, vibration and whirl, absolute and relative height of features within a derrick, pressures, temperatures, flow velocities, mud viscosity, mass flow, density, water content, plug detection, pig or ball status, hydraulic circuit pressure at any point in circuits, and so forth. As an example, the control feature 880 may cooperate or include strain sensitive devices (e.g., metal foil or semiconductor strain gauges) applied to the body of the gripping device 1400 to measure lifting load, torque load, bending force, mud pressure, or the like. The control feature 880 may be configured to indicate the passage of the drillpipe element 102 into the gripping device 1400 such that an actuation sequence in activated upon full insertion. The control feature 880 may include a detection mechanism (e.g., a mechanical switch, optical device, ultrasonic sensor, or hall effect sensor) that is contact-based or non-contact-based. Specifically, for example, the control feature 880 may determine that the pipe upset has been sufficiently inserted into the gripping device 1400 and then trigger closing of the elevators 1410, actuation of the sealing mechanism 600, and initiation of the torsional clamping actuators 1410.

Figure 22:
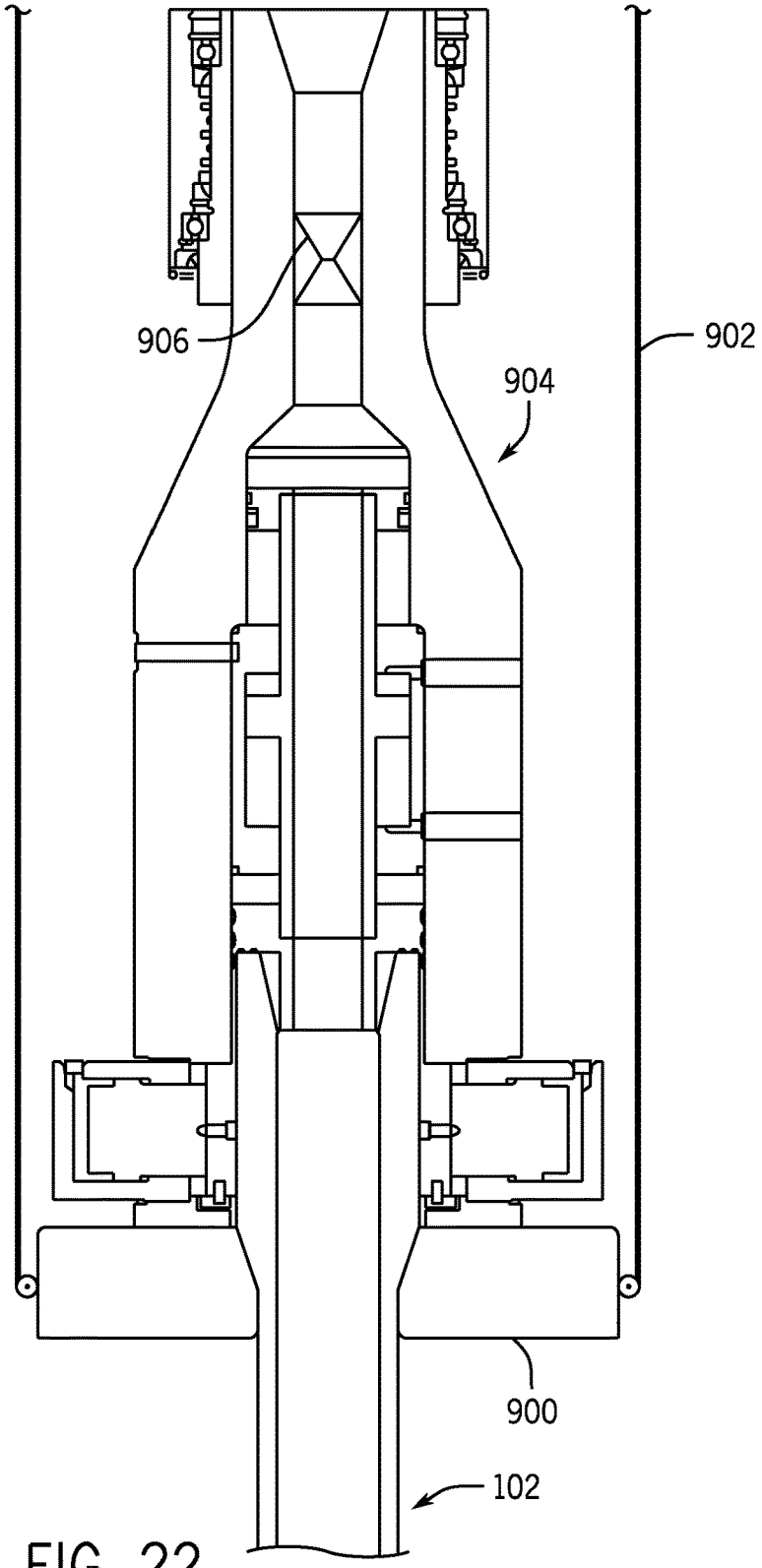
FIG. 22 is a cross-sectional view of a gripping device and a separate elevator mechanism in accordance with present techniques.

While the embodiments illustrated and discussed above with respect to FIGS. 9-14 represent embodiments of the gripping device 1400 including integral elevators 1410, some embodiments may not include an integral elevator. For example, FIG. 22 illustrates an embodiment wherein a separate elevator 900 on a linkage 902 may be used to couple with the drillpipe element 102 and bring the drillpipe element 102 into engagement with a gripping device 904 that excludes the integral elevators 1410, but includes other features of the gripping device 1400 illustrated in FIGS. 9-14. Utilizing the separate elevator 900 (e.g., a conventional elevator separate from the gripping device) may facilitate coupling with the drillpipe element 102 while the drillpipe element 102 is laying horizontally.

It should also be noted that FIG. 22 illustrates an integrated valve 904 that is representative of a valve that can be utilized to prevent dumping of stored fluid (e.g., mud) or as a blow out preventer. A valve, such as the integrated valve 904, may be employed in various locations in a gripping device (e.g., 1400, 904) in accordance with present embodiments to avoid undesired flow of fluid into the drillpipe element 102 or out of the gripping device. Actuation of the valve may be controlled via integral features of the gripping device, such as the control feature 880.

As will be appreciated, any of the systems, components, and methods in the embodiments described above may be used in various combinations with one another. Indeed, components from the different embodiments described above may be combined or used with one another in other embodiments, which fall within the scope of the present disclosure. For example, the valve 72 shown in FIG. 2 configured to regulate flow of drilling mud through the gripping device 42 may be included with the gripping device 1400 shown in FIGS. 9-12. Additionally, the valve 72 may be controlled by the controller 52 based on feedback from sensors 70, 402, where the sensors 70, 402 are configured to measure one or more operating parameters of the gripping device 1400 or other operating parameter of the drilling rig 10. Indeed, the sensors 70, 402 may be configured to monitor operation or functionality of any of the components or systems described above. Feedback from the sensors 70, 402 may then be used by the controller 52 to control any of the above components to regulate a drilling mud flow through the drillpipe 38, drill string 28, and wellbore 30.

As discussed in detail above, embodiments of the present disclosure are directed to systems and methods for circulating mud or other fluid within the wellbore 30 during insertion and/or removal of drillpipe elements (e.g., sections of drillpipe 38) into and out of the wellbore 30. For example, the pipe drive system 40 may be configured to create a seal between the drillpipe handling equipment (e.g., gripping device 42, 1400) and the drillpipe 38 such that fluid can efficiently pass from the pipe drive system 40 into the drillpipe 38, the drill string 28, and the wellbore 30. The flow of drilling mud or other fluid through the drillpipe 38 and within the wellbore 30 may be controlled and regulated by a control system 400 (e.g., controller 52 and sensors 402), during insertion or removal of the drillpipe 38. For example, the flow of mud or other fluid may be based on measured feedback or operating parameters associated with the insertion and/or removal of the drillpipe 38. In other embodiments, the flow of mud or other fluid may be based on calculated profile or schedule (e.g., a schedule of flow rates of the mud, where the schedule is based on previously calculated parameters).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A pipe drive system, comprising:

a gripping device configured to couple with a pipe element;

a sealing mechanism comprising a seal disposed between the gripping device and the drill pipe element;

a strain gauge disposed on the seal and adapted to measure seal pressure;

a pump configured to pump a drilling fluid flow through the gripping device and the pipe element while the pipe element is being installed into or removed from a wellbore; and a controller configured to regulate a flow rate of the drilling fluid flow while the pipe element is being installed into or removed from the wellbore based on one or more operating parameters associated with installing or removing the pipe element from the wellbore, the one or more operating parameters, comprising the seal pressure.

2. The system of claim 1, wherein the controller is configured to regulate operation of the pump based on feedback from one or more sensors, wherein the one or more sensors are configured to measure operating parameters of a drilling rig.

3. The system of claim 2, wherein the operating parameters comprise a pressure within the wellbore, a vacuum within the wellbore, an installation or removal rate of the pipe element, a flow rate of the drilling fluid, or any combination thereof.

4. The system of claim 1, wherein the sealing mechanism is configured to create a sealing interface between the gripping device and the pipe element and facilitate flow of the drilling fluid through the gripping device into the pipe element.

5. The system of claim 1, comprising:

a housing of the gripping device configured to extend over and at least partially around a distal end of the pipe element; and clamp devices configured to engage an outer circumferential surface of the pipe element with frictional engagement features that extend radially inward from the housing.

6. The system of claim 1, wherein the controller is configured to regulate the pump to pump the drilling fluid through the gripping device and the pipe element proportionally to the volume of the pipe element being installed into or removed from the well bore.

7. A control system, comprising:

a seal disposed between a drillpipe element and a gripping device configured to grip the drill pipe element;

a strain gauge configured to measure seal pressure of the seal, the seal pressure corresponding with one or more operating parameters associated with installation or removal of the drill pipe element from the wellbore; and a controller configured to regulate a drilling fluid flow rate through the pipe element during installation of the pipe element into a wellbore or removal of the pipe element from the wellbore, wherein the controller is configured to regulate the drilling fluid flow rate based on the seal pressure of the seal.

8. The system of claim 7, wherein the control system comprises the one or more sensors, and the one or more sensors are configured to measure one or more operating parameters of a drilling rig having the controller.

9. The system of claim 8, wherein the controller is configured to regulate operation of a mud pump based on the one or more operating parameters measured by the one or more sensors, wherein the mud pump is configured to pump the drilling fluid flow.

10. The system of claim 8, where in the one or more operating parameters comprises a pressure within the wellbore, a vacuum within the wellbore, a flow rate of the drilling fluid, an installation rate of the pipe element, a removal rate of the pipe element, or any combination thereof.

11. A method of assembling or disassembling a drill string, comprising:

circulating a drilling fluid through the drill string and into a wellbore in which the drill string is disposed with a pump during installation or removal of a drillpipe element of the drill string;

measuring one or more operating parameters associated assembling or disassembling the drill string, wherein the one or more operating parameters comprises a seal pressure of a seal disposed between a gripping device configured to grip the drillpipe element and the drillpipe element, wherein the seal pressure is measured by a strain gauge disposed on the seal; and controlling a flow rate of the drilling fluid based on the one or more operating parameters.

12. The method of claim 11, comprising pumping the drilling fluid through the drill string and into the wellbore at a rate proportional to an installation rate or a removal rate of the drill pipe element of the drill string into the well bore or from the well bore.

13. The method of claim 11, wherein controlling the flow rate of the drilling fluid based on the one or more operating parameters comprises initiating operation of a mud pump configured to pump the drilling fluid.

14. The method of claim 11, wherein controlling the flow rate of the drilling fluid based on the one or more operating parameters comprises opening a valve configured to regulate flow of the drilling fluid.

15. The method of claim 11, wherein the one or more operating parameters comprises a pressure within the wellbore, a vacuum within the wellbore, a flow rate of the drilling fluid, an installation rate of the drillpipe element of the drill string, a removal rate of the drillpipe element of the drill string, or any combination thereof.

16. The method of claim 11, comprising increasing a flow rate of the drilling fluid after the drillpipe element is removed from the wellbore.

17. The method of claim 11, comprising injecting compressed air into the drillpipe element after the drillpipe element is removed from the wellbore.

18. The method of claim 11, comprising pumping the drilling fluid through the drill string and into the wellbore at a rate faster than a removal rate of the drill pipe element of the drill string from the well bore.

* * * * *